US010352073B2

(12) United States Patent
Lee et al.

(10) Patent No.: US 10,352,073 B2
(45) Date of Patent: Jul. 16, 2019

(54) HOUSEHOLD ELECTRIC APPLIANCES HAVING DOOR KEY LINKED TO ROTATION OF DOOR

(71) Applicant: Samsung Electronics Co., Ltd., Suwon-si (KR)

(72) Inventors: Jea-won Lee, Hwaseong-si (KR); Boo-keun Yoon, Yongin-si (KR); Yong-soo Kyong, Yongin-si (KR); Yong-jong Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/489,348

(22) Filed: Apr. 17, 2017

(65) Prior Publication Data

US 2017/0298663 A1 Oct. 19, 2017

(30) Foreign Application Priority Data

Apr. 15, 2016 (KR) ..... 10-2016-0046094

(51) Int. Cl.
*E05C 3/12* (2006.01)
*E05B 63/12* (2006.01)
(Continued)

(52) U.S. Cl.
CPC ..... *E05C 3/12* (2013.01); *D06F 39/14* (2013.01); *E05B 15/022* (2013.01);
(Continued)

(58) Field of Classification Search
CPC .... D06F 39/14; E05B 63/128; E05B 65/0042; F24C 15/023; F25D 23/028; H05B 6/6417
See application file for complete search history.

(56) References Cited

U.S. PATENT DOCUMENTS 1,468,735 A * 9/1923 Meadows ..... F24C 15/023 126/191
3,119,388 A * 1/1964 Brett ..... F24C 15/023 126/191
(Continued)

FOREIGN PATENT DOCUMENTS

EP 1 431 671 B1 6/2004
EP 2 998 429 A1 3/2016
(Continued)

OTHER PUBLICATIONS

International search Report dated Jul. 19, 2017, in corresponding International Patent Application No. PCT/KR2017/004108.
(Continued)

*Primary Examiner* — Hanh V Tran
(74) *Attorney, Agent, or Firm* — Staas & Halsey LLP

(57) ABSTRACT

A household electric appliance in which a door key is operated in association with an opening/closing operation of a door and is drawn into an inside of the door in the door opening operation is provided. The household electric appliance includes a main body having a space therein, a door coupled to the main body to be rotatable about a first rotation axis to open and close, respectively, the space, and a door key coupled to one of the main body and the door, the door key rotatable about a second rotation axis, so that a rotation of the door about the first rotation axis causes the door key to rotate about the second rotation axis.

17 Claims, 29 Drawing Sheets

(51) Int. Cl.

| | |
|---|---|
| ***F24C 15/02*** | (2006.01) |
| ***F25D 23/02*** | (2006.01) |
| ***D06F 39/14*** | (2006.01) |
| ***E05B 15/02*** | (2006.01) |
| ***H05B 6/64*** | (2006.01) |
| ***F25D 29/00*** | (2006.01) |

(52) U.S. Cl.

CPC ..... *E05B 63/128* (2013.01); *F24C 15/023* (2013.01); *F25D 23/028* (2013.01); *F25D 29/006* (2013.01); *H05B 6/6414* (2013.01); *E05B 2015/0235* (2013.01); *F25D 2323/023* (2013.01)

(56) References Cited

U.S. PATENT DOCUMENTS

| | | | | |
|---|---|---|---|---|
| 3,299,879 | A * | 1/1967 | Doner | F24C 15/023 126/194 |
| 4,021,968 | A * | 5/1977 | Kendall | E05F 1/1075 126/191 |
| 4,547,642 | A * | 10/1985 | Smith | F24C 14/00 126/21 A |
| 6,397,836 | B1 * | 6/2002 | Pelletier | E05F 1/1276 126/194 |
| 6,789,293 | B2 * | 9/2004 | Habegger | E05F 1/1276 16/289 |
| 7,318,633 | B2 | 1/2008 | Shin et al. | |
| 9,181,737 | B1 * | 11/2015 | Kadus | E05D 11/0054 |
| 2006/0226751 | A1 | 10/2006 | Park | |
| 2011/0148262 | A1 | 6/2011 | Basavalingappa Mudbasal et al. | |
| 2013/0069512 | A1 * | 3/2013 | Zimmer | H05B 1/00 312/326 |
| 2014/0097172 | A1 * | 4/2014 | Kang | F24C 15/02 219/394 |
| 2014/0197161 | A1 * | 7/2014 | Dobie | H05B 6/6417 219/724 |
| 2015/0345194 | A1 | 12/2015 | Kadus et al. | |

FOREIGN PATENT DOCUMENTS

| | | |
|---|---|---|
| JP | 2012-145314 | 8/2012 |
| KR | 1991-0000720 | 5/1989 |
| KR | 10-2014-0050475 | 4/2014 |
| KR | 10-2014-0110691 | 9/2014 |
| KR | 10-1480241 | 1/2015 |
| WO | WO 2009/116094 A1 | 9/2009 |

OTHER PUBLICATIONS

Written Opinion of the International Searching Authority dated Jul. 19, 2017, in corresponding International Patent Application No. PCT/KR2017/004108.

European Office Action dated Oct. 24, 2018 in corresponding European Patent Application No. 17782716.9.

* cited by examiner

HOUSEHOLD ELECTRIC APPLIANCES HAVING DOOR KEY LINKED TO ROTATION OF DOOR

CROSS-REFERENCE TO RELATED APPLICATIONS

This application claims priority from Korean Patent Application No. 10-2016-0046094, filed on Apr. 15, 2016, in the Korean Intellectual Property Office, the disclosure of which is incorporated herein by reference in its entirety.

BACKGROUND OF THE INVENTION

Field of the Invention

Apparatuses and methods consistent with exemplary embodiments relate to household electric appliances, and more particularly, to household electric appliances having a door key operated to lock/unlock a door to/from a main body in association with rotation of the door.

Description of the Related Art

In general, ovens may be apparatuses which seal and cook cooking materials through heat and may be divided into an electric type, a gas type, and an electronic type. The electric ovens may use an electric heater as a heat source, the gas ovens may use heat by gas as a heat source, and the microwave ovens may use frictional heat of water molecules by radio frequency as a heat source.

The oven may include a door key which prevents a cooking chamber from being opened during cooking in a door. The door key may be locked through a locking member installed in a main body of the oven and may keep the door close.

However, in response to the door being opened to put cooking materials into the cooking chamber or take out the cooking materials from the cooking chamber, the door key may protrude from the door and thus the catching of a container containing the cooking materials, a user's hand, and the like by the door key may be caused.

SUMMARY OF THE INVENTION

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to household electric appliances in which a door key is operated in association with an opening/closing operation of a door and is drawn into an inside of the door in the door opening operation.

According to an aspect of an exemplary embodiment, there is provided a household electric appliance including a main body having a space therein; a door pivotally coupled to the main body to be rotatable about a first rotation axis to open and close, respectively, the space; and a door key pivotally coupled to one of the main body and the door, the door key rotatable about a second rotation axis, different than the first rotation axis, so that a rotation of the door about the first rotation axis causes the door key to rotate about the second rotation axis.

The door key may be pivotally coupled to the door.

The household electric appliance may further include a link between the main body and the door key, wherein one end of the link is pivotally coupled to the main body and the other end is pivotally coupled to the door key so as to be rotatable about a fourth rotation axis.

When the door rotates to open, the door may rotate through a preset angle section, and the link may have a length that varies while the door rotates through at least a portion of the preset angle section.

The link may include a first part and a second part slidably coupled to each other along a length direction and an elastic member configured to elastically couple the first part and the second part so that a total length of the link is elastically increased or reduced.

A rotation center of the second rotation axis may be arranged closer to the main body than a pivot point of the other end of the link about the fourth rotation axis.

The link may be disposed in an inside of the door.

When the door rotates to open, the door may rotate through a first angle section and then a second angle section, and the door key may rotate about the second axis while the door rotates through the first angle section, and the door key may not rotate about the second axis while the door rotates through the second angle section.

The door key may rotate in a same direction as a rotation direction of the door while the door rotates through the first angle section.

The door key may rotate in a direction opposite to a rotation direction of the door while the door rotates through the first angle section.

The door includes a hole on an inner surface of the door, as the door rotates through the first angle section, the door key enters the hole, and the door key may be located inside the hole of the door while the door rotates through the second angle section.

The door key may include an extension portion formed in one end of the door key, and the household electric appliance may further include a weight structure coupled to the extension portion so that the door key maintains a level orientation while the door rotates to open.

The door key may rotate in a direction opposite to a rotation direction of the door while maintaining the level orientation with respect to rotation of the door.

The door key may include an elastic member having an elastic force, the household electric appliance may further include a weight structure coupled to a portion of the door key, and a total weight, which is a sum of a weight of the door key and a weight of the weight structure, is equal to or larger than the elastic force of the elastic member.

A weight center of the door key and the weight structure gradually, taken together, may move toward the second axis of the door key according to the rotation of the door.

The door may include a hole on an inner surface of the door, and as the weight center moves to a position corresponding to the elastic force of the elastic member, thereby overcoming the total weight, the door key may rotate and be drawn into the hole of the door.

The door key may be pivotally coupled to a portion of the main body and include a first portion and a second portion, and when the door is closed, the first portion may protrude from the main body and the second portion may recede into the main body and when the door is open, the first portion may recede into the main body and the second portion may protrude from the main body.

The door may include an insertion hole into which the first portion of the door key is inserted when the door is closed, and the main body may interfere with the door key through a cam structure in response to the first portion of the door key being inserted into the insertion hole as the door rotates to close.

The household electric appliance may be any one of a microwave oven, an oven, a refrigerator, and a washing machine.

The one of the main body and the door may include a hole on a surface of the one of the main body and the door, and as the door rotates to open, the door key may rotate about the second axis so that the door key is drawn into the hole.

According to an aspect of an exemplary embodiment, there is provided a household electric appliance including a main body; a door pivotally coupled to the main body and configured to open and close an opening of the main body; a door key pivotally coupled to a portion of the door and configured to be drawn into the door or drawn out from the door; and a link of which one end is pivotally coupled to the main body and the other end is pivotally coupled to the door key. The door key may be drawn into the door or drawn out from the door by receiving rotation force of the door from the link in a first angle section in which the door rotates.

Additional aspects and advantages of the exemplary embodiments are set forth in the detailed description, and will be obvious from the detailed description, or may be learned by practicing the exemplary embodiments.

BRIEF DESCRIPTION OF THE DRAWING FIGURES

The above and/or other aspects of the present invention will be more apparent by describing certain exemplary embodiments of the present invention with reference to the accompanying drawings, in which:

FIGS. 4 and 5 are detailed diagrams illustrating a microwave oven or an oven as an example of a household electric appliance according to an exemplary embodiment, wherein FIGS. 4 and 5 are perspective views illustrating examples that a door opens and closes a cooking chamber of a main body;

DETAILED DESCRIPTION OF THE EXEMPLARY EMBODIMENTS

Figure 1A:
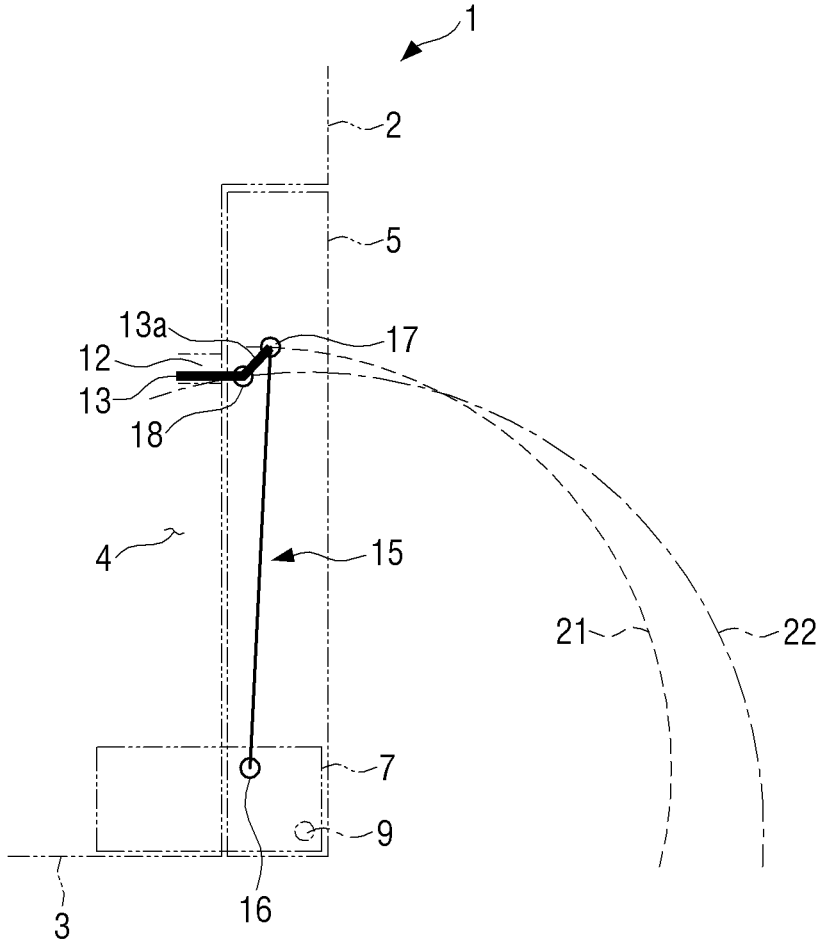
FIGS. 1A to 1D are diagrams sequentially illustrating an operation of a door key linked to rotation of a door of a household electric appliance according to an exemplary embodiment.

Various embodiments will now be described more fully with reference to the accompanying drawings in which some embodiments are shown. The techniques described herein are exemplary, and should not be construed as implying any particular limitation on the present disclosure. It should be understood that various alternatives, equivalents, and/or modifications could be devised by those skilled in the art. In the following description, unless otherwise described, the same reference numerals are used for the same elements when they are depicted in different drawings.

It will be understood that, although the terms first, second, etc. may be used herein in reference to elements of the invention regardless of an order and/or importance, such elements should not be construed as limited by these terms. The terms are used only to distinguish one element from other elements. For example, a first user apparatus and a second user apparatus may refer to different user apparatuses from each other regardless of an order and/or importance. For example, without departing from the spirit of the inventive concept, a first element may refer to a second element, and similarly, the second element may refer to the first element.

As used herein, the singular forms "a," "an" and "the" are intended to include the plural forms as well, unless the context clearly indicates otherwise. The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this inventive concept belongs. Terms defined in general dictionaries among the terms used herein may be interpreted to have the same meaning as or the similar meaning to the contextual meaning in the related art. Unless otherwise defined, the terms used herein may not be interpreted to have the ideal or overly formal meaning. In some cases, even terms defined herein may not be interpreted to exclude the exemplary embodiments herein.

Hereinafter, a structure of a door key linked to a door of a household electric appliance according to an exemplary embodiment will be first described with reference to the accompanying drawings and then a detailed example of the door key applied to an oven according to an exemplary embodiment will be described.

Figure 2:
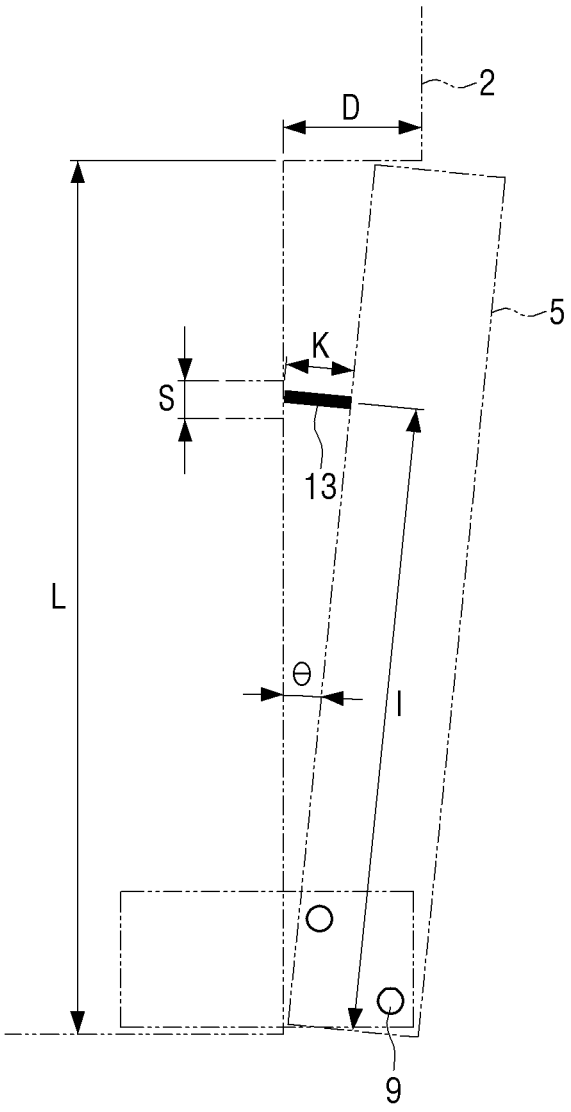
FIG. 2 is a schematic diagram explaining a mathematical expression related to a horizontal length of an insertion hole of a main body into which a door key is inserted and a length of the door key protruding from the door according to an exemplary embodiment.
Figure 3:
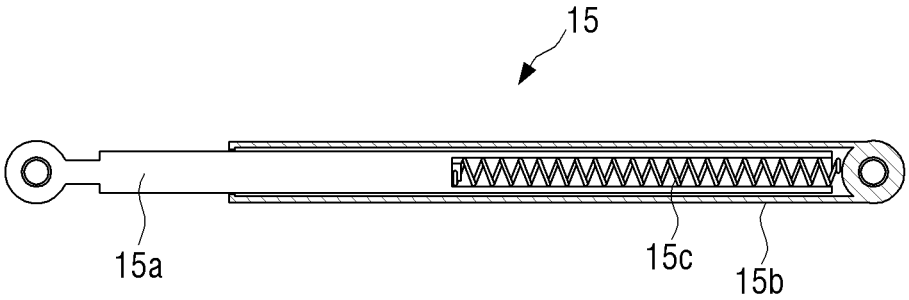
FIG. 3 is a schematic diagram illustrating a link which couples a main body and a door key and operates the door key according to rotation of the door according to an exemplary embodiment.

FIGS. 1A to 1D are diagrams sequentially illustrating an operation of a door key linked to rotation of a door of a household electric appliance according to an exemplary embodiment. FIG. 2 is a schematic diagram explaining a mathematical expression related to a horizontal length s of an insertion hole of a main body into which a door key is inserted and a length 1 of the door key protruding from the door according to an exemplary embodiment. FIG. 3 is a schematic diagram illustrating a link which couples a main body and a door key and operates the door key according to rotation of the door according to an exemplary embodiment.

Referring to FIG. 1A, a household electric appliance 1 may include a door 5 rotatably pivotally coupled to a main body 3. The main body 3 may include a fixed space 4 in the inside of the main body 3. The door 5 may open and close the space 4 of the main body 3 according to rotation. The main body 3 may include an operation unit 2 disposed over the door 5.

The operation unit 2 may include various components configured to control the main body 3, for example, a touch screen, a control button, a control knob, a display, and the like. The operation unit 2 may be disposed not over a front of the door 5 but in various positions, for example, in the left and right of the front, a top surface, and the like of the door 5. However, the operation unit 2 may not be a unit configured to control functions but may be merely a protrusion portion protruding from the main body 3.

The door 5 may be pivotally (by way of a rotation axis) coupled to a supporting piece 7 fixed to the main body 3 through a first rotation shaft 9. For example, the door 5 may be rotated clockwise and counterclockwise about the first rotation shaft 9 to open and close the space 4 of the main body 3. For example, in response to the space 4 being closed through the door 5 as illustrated in FIG. 1A, the door 5 may be fixed to the main body 3 so that the door may keep close and may not rotate. In this example, the door 5 may include a door key 13 configured to fix the door to the main body 3.

The door key 13 may be installed to be drawn into and drawn out from the door 5 in association with the rotation of the door 5. For example, in response to the door 5 being rotated clockwise and counterclockwise to open and close the space 4 of the main body 3, the door key 13 may be rotated in association with the rotation of the door 5 and the door key 13 may be drawn out from the door 5 or may be drawn into the inside of the door 5. Here, the sentence "the door key 13 may be drawn into the inside of the door 5" may mean that the door key 13 may be inserted into the inner side of the door 5 through a hole formed in an inner surface of the door 5 toward the space 4 of the main body 3 in the closing of the door 5 wherein the door key 13 may be inserted into the inside of the door 5 sufficient not to protrude from the inner surface of the door 5. Accordingly, even in response to the door key 13 being inserted into the inside of the door 5, a portion of the door key 13 may be exposed to the outside through the hole formed in the inner surface of the door 5.

For example, in response to the door 5 being located in a position (hereinafter, referred to as 'first position') fixed to the main body 3 in a state that the space 4 of the main body 3 is closed through the door 5 as illustrated in FIG. 1A, the door key 13 may be inserted into the inside of the main body 3 through an insertion hole 12 formed in the main body 3 in a state that the door key 13 protrudes from the inner side of the door 5. In this example, the door key 13 may be locked through a certain locking member (not shown) provided in the inside of the main body 3.

Figure 1B:
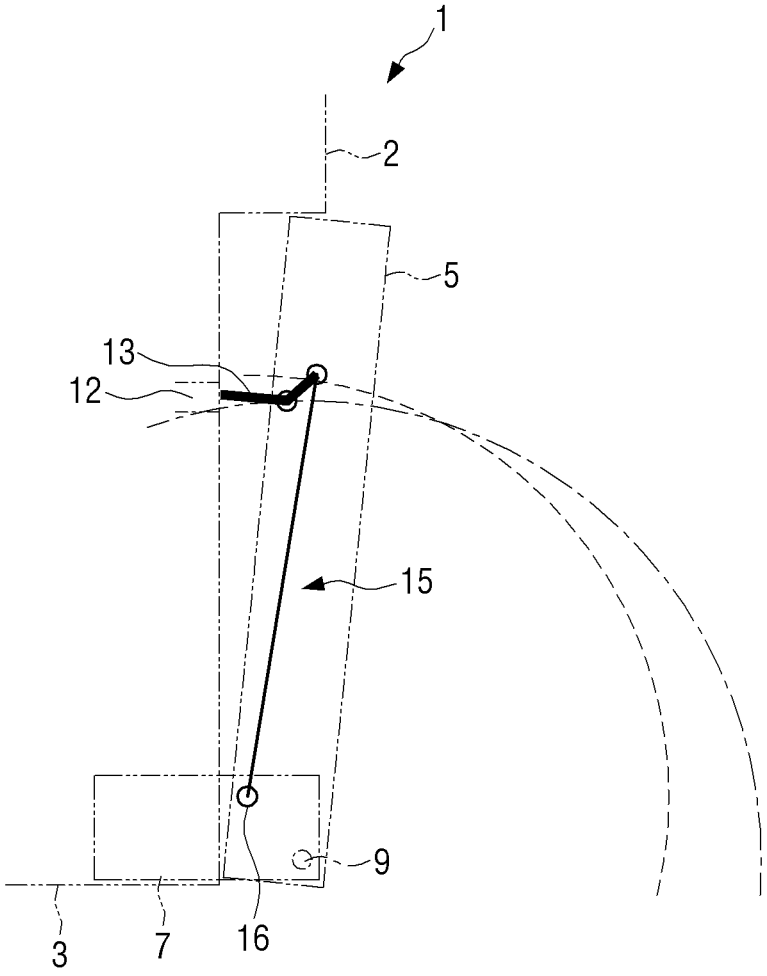

In another example, in response to the door 5 being located in a position (hereinafter, referred to as 'second position') that the door 5 is rotated clockwise at a fixed angle about the first rotation shaft 9 to open the space 4 of the main body 3 as illustrated in FIG. 1B, the door key 13 may rotate clockwise by receiving rotation force of the door 5 through a link 15 to be described later and simultaneously may be drawn out from the insertion hole 12 of the main body 3. In this example, the locking member may release the locking state of the door key 13 through force that the door 5 is pulled clockwise.

For example, the insertion hole 12 of the main body 3 may be manufactured in consideration of a vertical length of the insertion hole 12 so as not to interfere with the door key 13 in response to the door key 13 being drawn out from the insertion hole 12. In this example, since the rotation amount of the door key 13 is small in response to the door 5 being rotated from the first position to the second position, the insertion hole 12 may be also formed to have the small vertical length.

Referring to FIG. 2, the vertical length s of the insertion hole 12 of the main body 3 may be obtained as the following Equation 1 in consideration of a length k of the door key 13 protruding from the door 5 and a distance 1 from a lower end of the door 5 to the door key 13.

$$(s+l)^2=k^2+l^2$$

$$s=-l+\sqrt{k^2+l^2} \qquad \text{[Equation 1]}$$

The vertical length s of the insertion hole 12 obtained through Equation 1 may be set to an appropriate value in consideration of various conditions such as a safety standard.

The protruding length k of the door key 13, which may protrude from the door 5 so that the door key 13 may be inserted into the insertion hole 12 without interference of the insertion hole 12, may be obtained as the following Equation 2 in consideration of a vertical length L of a front surface of the main body 3 corresponding to a total height of the door 5, a protruding length D of the operation unit 2 which protrudes toward a front of the main body 3 from the front surface of the main body 3, and the distance 1 from the lower end of the door 5 to the door key 13.

$$\tan\theta = \frac{D}{L} = \frac{k}{L} \qquad \text{[Equation 2]}$$

$$k = \frac{D}{L}l = l\cdot\tan\theta$$

An angle θ that the door key 13 is completely drawn out from the insertion hole 12 of the main body 3 may be obtained as the following Equation 3 through Equation 2.

$$\theta = \tan^{-1}\left(\frac{D}{L}\right) \qquad \text{[Equation 3]}$$

The door key 13 may simultaneously rotate from the angle θ in the rotation of the door 5 without interference of the insertion hole 12. While the door 5 rotates to a position (hereinafter, referred to as 'third position) illustrated in FIG. 1C from the second position, the door key 13 may rotate to the same direction as the rotation direction of the door 5 in association with the rotation of the door 5 and simultaneously may be drawn into the inside of the door 5.

For example, the operation that the door key 13 is drawn into the inside of the door 5 may be performed through the rotation force of the door 5. In this example, the rotation force of the door 5 may be transferred to the door key 13 through the link 15.

One end portion 15*a* of the link 15 may be pivotally coupled to the supporting piece 7 through a second rotation shaft 16 and the other end portion 15*b* of the link 15 may be pivotally coupled to the other end portion 13*a* of the door key 13 through a third rotation shaft 17. The door key 13 may be pivotally coupled to a portion of the door 5 through a fourth rotation shaft 18.

In response to a fixed angle being formed through the door 5 as illustrated in FIG. 1B in the opening process of the door 5, the door key 13 may be completely drawn into the inside of the door 5. In the state that the door key 13 is completely drawn into the inside of the door 5, the door 5 may continuously rotate clockwise and completely open the space 4 of the main body 3 as illustrated in FIG. 1C.

Figure 1C:
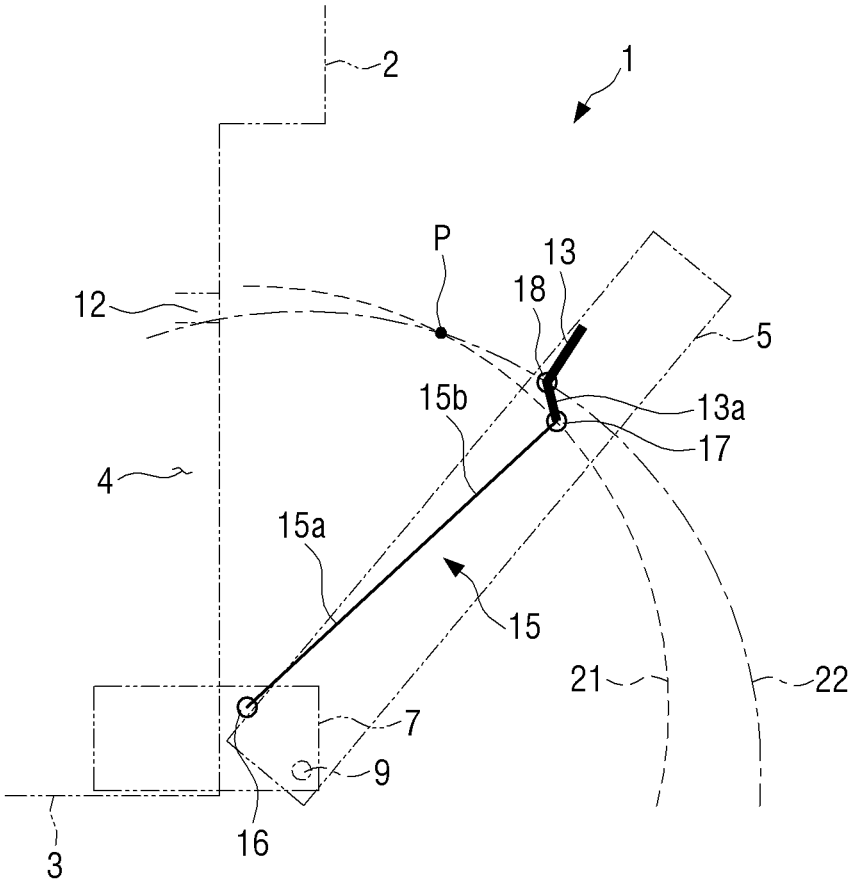
Figure 1D:
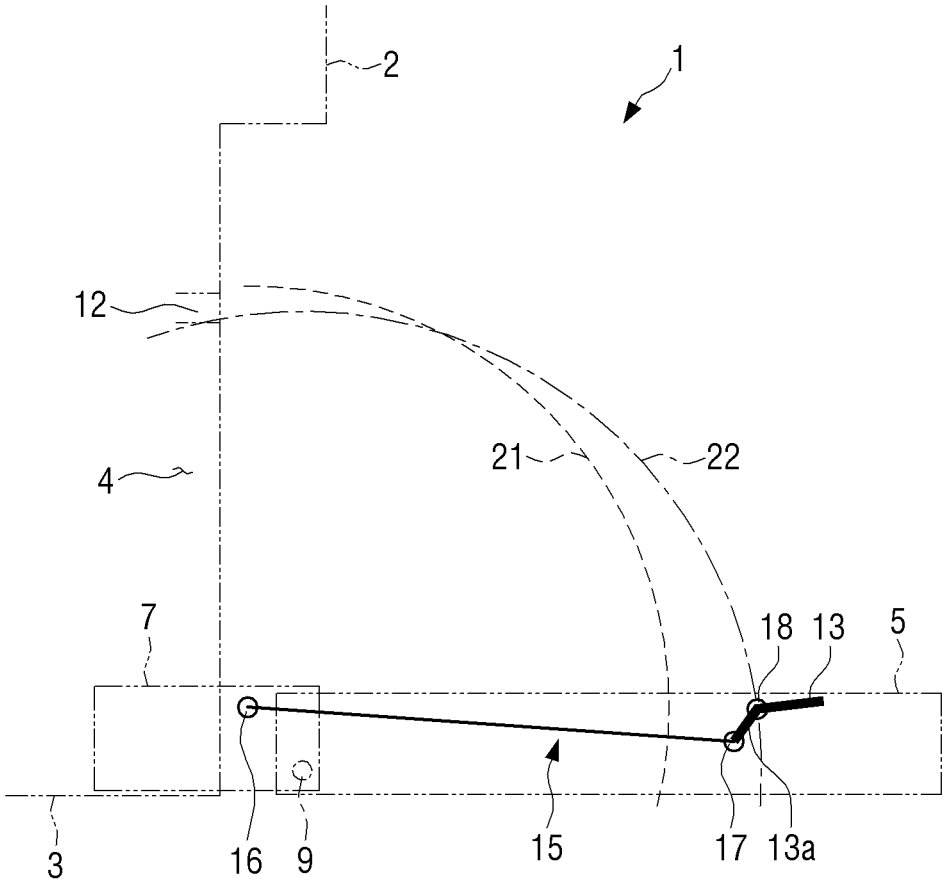

The length of the link 15 has to be increased to rotate the door 5 from the position of FIG. 1B to the position of FIG. 1C. To increase the length of the link 15, the link 15 may have a structure that the length is variable. For example, as illustrated in FIG. 3, the one end portion 15*a* and the other end portion 15*b* of the link 15 may be separately formed and the one end portion 15*a* of the link 15 may be slidably coupled to the inner side of the other end portion 15*b*. In this example, an elastic member 15*c* configured to provide fixed elastic force may be disposed between the one end portion 15*a* and the other end portion 15*b* of the link 15. The elastic member 15*c* may be configured of a tension spring or a compression spring.

It has been described in the exemplary embodiment that the link 15 includes the one end portion 15*a* and the other end portion 15*b* slidably coupled to each other and the elastic member 15*c* configured to elastically couple the one end portion 15*a* and the other end portion 15*b*, but this is not limited thereto and the link 15 may be configured of a single member having fixed elasticity.

The link 15 configured of the single member having the elasticity may have a minimum length sufficient to pull the other end portion 13*a* of the door key 13 upward so that the door key 13 is drawn out from the door 5 and is drawn into the portion of the main body 3 in response to the space 4 being closed through the closing of the door 5 as illustrated in FIG. 1A.

As illustrated in FIG. 1A, as the door 5 is rotated, a rotation trajectory 21 of the third rotation shaft 17 may not coincide with a rotation trajectory 22 of the fourth rotation shaft 18 and may be different from the trajectory 22 of the fourth shaft 18. This is because a distance between the third rotation shaft 17 and the first rotation shaft 9 is different from a distance between the fourth rotation shaft 18 and the first rotation shaft 9.

The point of time when the door key 13 is completely drawn into the inside of the door 5 may be any point of a section that the door 5 is rotated from the position of FIG. 1A to the position of FIG. 1B after the door key 13 passes through a cross point (see P of FIG. 1C) that the trajectory 21 of the third rotation shaft 17 meets the trajectory 22 of the fourth rotation shaft 18. However, this is not limited thereto and the point of time when the door key 13 is completely drawn into the inside of the door 5 may be any point of the section before the door key 13 passes through the cross point P in response to the door 5 being rotated clockwise. The point of time when the door key 13 is completely drawn into the inside of the door 5 may be determined through various parameters, for example, the minimum length (variable length) of the link 15, the length of the other end portion 13*a* of the door key 13*a*, the distances to the third and fourth rotation shafts 17 and 18 from the first rotation shaft which are differently set from each other, and the like.

The rotation of the door key 13 may be accomplished during a section of from the second position to the third position so that the rotation of the door key 13 may not be recognized while the user opens the door 5 in the front of the main body 3. This is because while the door 5 rotates in the section of from the second position to the third position, the door key 13 may be covered with the operation unit 2 located over the door 5 and the upper portion of the door 5.

Hereinafter, a microwave oven or an oven 100 as an example of the above-described household electric appliance 1 according to the exemplary embodiment will be described. The example that the configuration of the door 5 and the door key 13 linked to the rotation of the door 5 provided in the household electric appliance 1 is applied to the oven 100 will be described.

Figure 4:
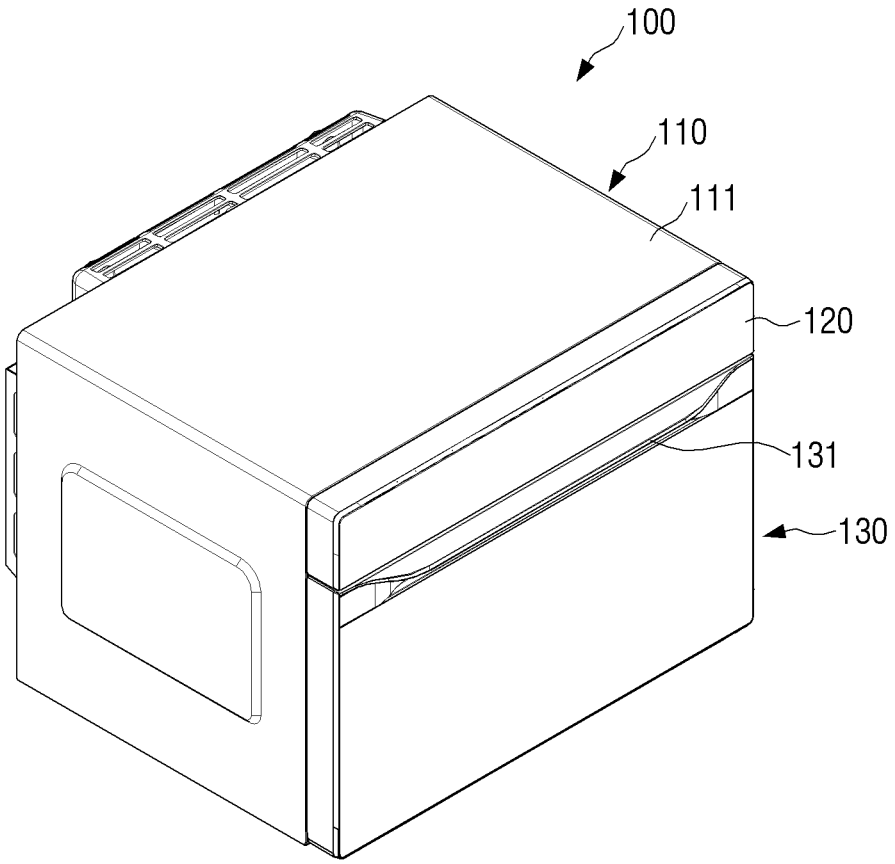
Figure 5:
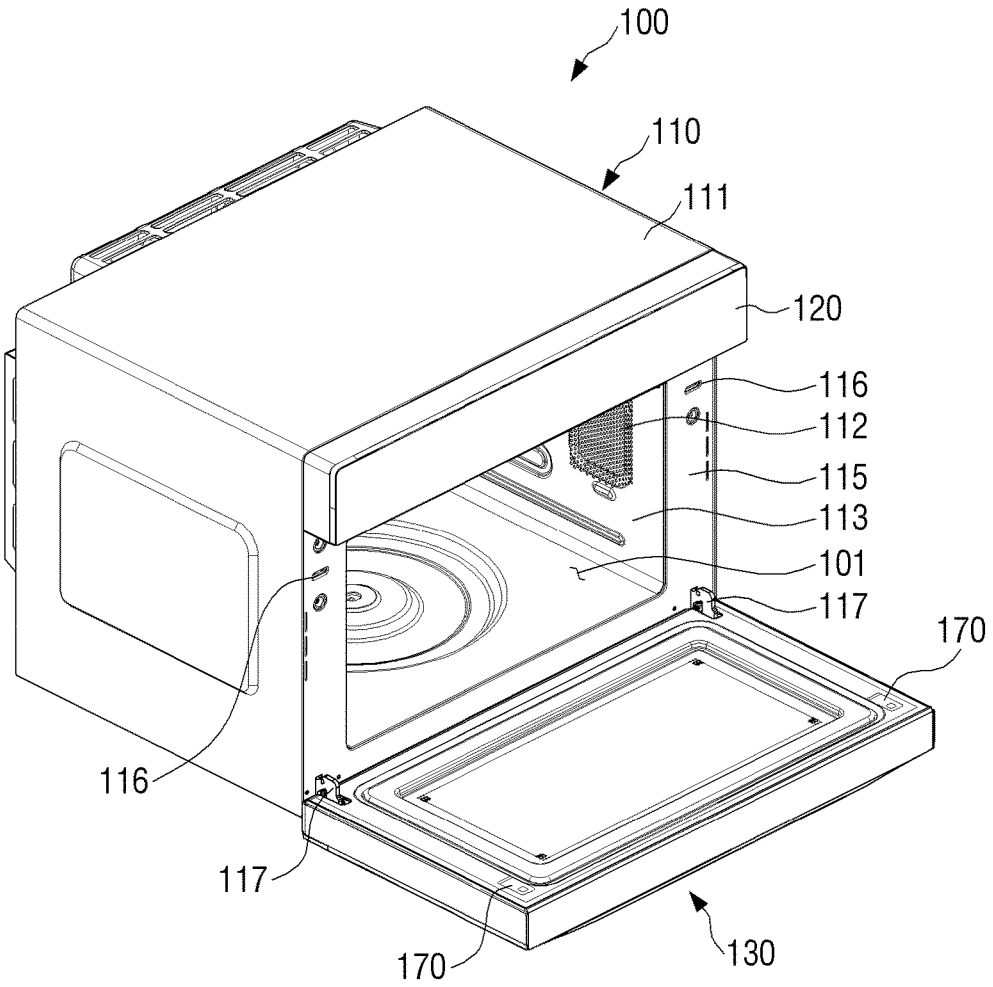

FIGS. 4 and 5 are detailed diagrams illustrating an oven as an example of a household electric appliance according to an exemplary embodiment, wherein FIGS. 4 and 5 are perspective views illustrating examples that a door opens and closes a cooking chamber of a main body.

Referring to FIGS. 4 and 5, the oven 100 according to an exemplary embodiment may include a main body 110 having a cooking chamber 101 in an inner side thereof and a door 130 configured to open and close the cooking chamber 101.

The main body 110 may include an outer case 111 and an inner case 113 configured to form the cooking chamber 101 in an inner side of the outer case 111. Although not shown in FIGS. 4 and 5, a heater, a convection fan, a cooling fan, and the like may be disposed between the outer case 111 and the inner case 113. The main body 110 may include an operation unit 120 located over the door 130. The operation unit 120 may include a control unit (not shown) in an inside thereof and may be electrically coupled to a door open/close detection sensor (not shown) disposed in a certain portion of the main body 110, for example, in a portion of a front portion 115 of the main body 110.

A plurality of intake holes 112 configured to allow the air in the outer side of the inner case 113 to be sucked into the cooking chamber 101 according to driving of a cooling fan (not shown) may be formed in the inner case 113. The plurality of intake holes 112 may be formed in both sides, a bottom, and a rear of the inner case 113.

A handle 131 which allow the user to open and close the door 130 may be provided in an outer front of the door 130. A lower end of the door 130 may be pivotally coupled to a lower end of the front portion 115 of the main body 110 through a pair of supporting pieces 117 disposed in both sides of the lower end of the front portion 115 of the main body 110. An insertion hole 116 into which a door key 170 is inserted may be formed in either side of an upper portion of the front portion 115 of the main body 110.

Figure 6:
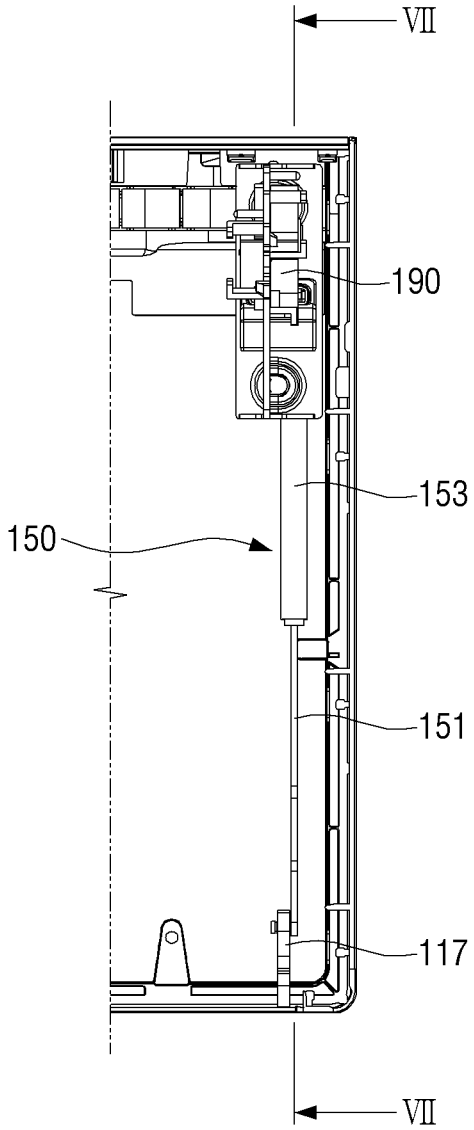
FIG. 6 is a partial cutout diagram illustrating a link disposed in an inner side of a door according to an exemplary embodiment.
Figure 7:
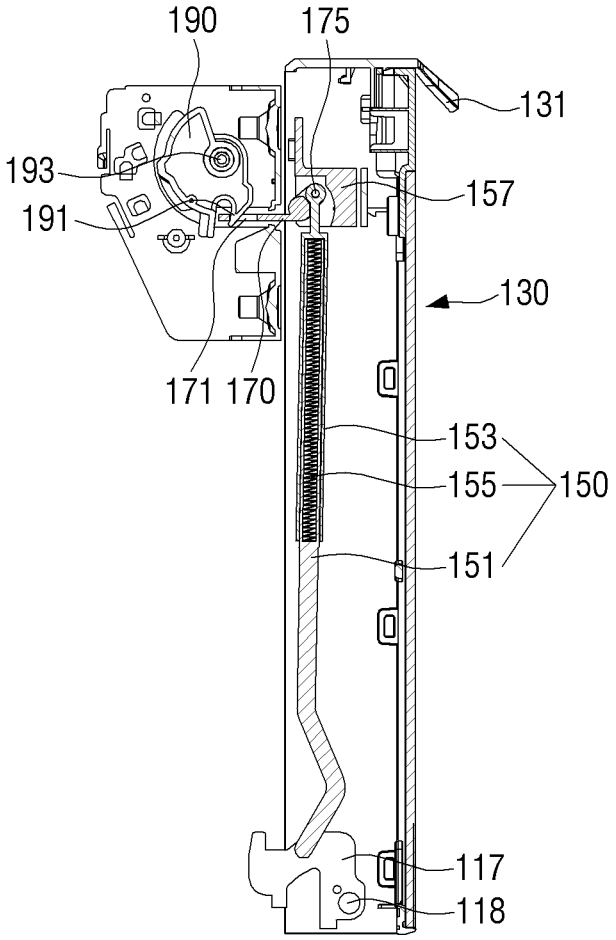
FIG. 7 is a cross-sectional diagram illustrating the link taken along line VII-VII of FIG. 6.
Figure 8:
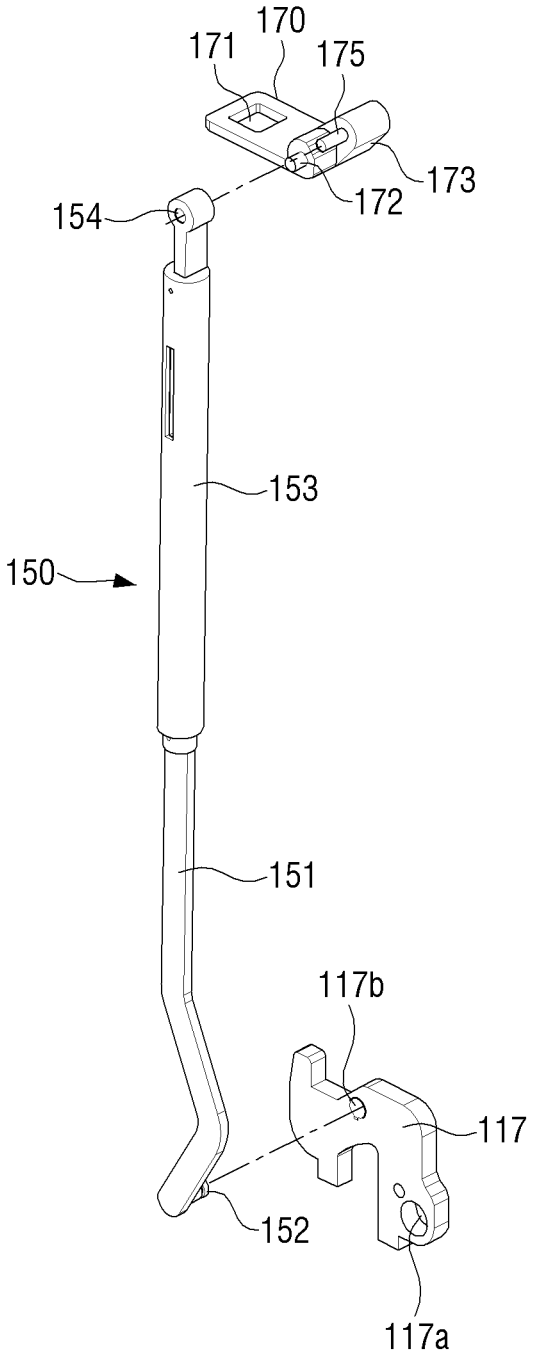
FIG. 8 is an exploded perspective view illustrating a structure that a door key and a supporting piece are pivotally coupled to an upper end portion and a end lower portion of a link according to an exemplary embodiment.

FIG. 6 is a partial cutout diagram illustrating a link disposed in an inner side of a door according to an exemplary embodiment. FIG. 7 is a cross-sectional diagram illustrating the link taken along line VII-VII of FIG. 6. FIG. 8 is an exploded perspective view illustrating a structure that a door key and a supporting piece are pivotally coupled to an upper end portion and a lower end portion of the link.

Referring to FIGS. 6 and 7, a link 150 may be disposed in the inside of the door 130. A lower end of the link 115 may be pivotally coupled to the supporting piece 117 and an upper end of the link 150 may be pivotally coupled to a hinge bracket 157 fixed to the inside of the door 130.

Referring to FIGS. 7 and 8, the link 150 may include a first part 151 having a fixed length, a second part 153 which has a fixed length and the first part 151 is slidably coupled thereto, and an elastic member 155.

A hinge protrusion 152 pivotally coupled to a second connection hole 117*b* of the supporting piece 117 may be formed to extend from one end portion of the first part 151. The other end portion of the first part 151 may be slidably coupled to the second part 153 along an inner side of the second part 153 and the elastic member 155 may be disposed in the inside of the second part 153. For example, one-side portion of the supporting piece 117 may be fixed to the inside of the main body 110 and the other-side portion of the supporting piece 117 may protrude from the outside of the main body 110 to rotatably support the door 130. In this example, a door hinge shaft 118 of the door 130 may be pivotally coupled to a first connection hole 117*a* formed in the other-side portion of the supporting piece 117. A connection hole 154 which a second rotation protrusion 175 of the door key 170 is pivotally coupled thereto may be formed in one end of the second part 153. One end of the elastic member 155 may be fixed to a portion of the inner side of the first part 151 and the other end of the elastic member 155 may be fixed to a portion of the inner side of the second part 153. Accordingly, the first and second parts 151 and 153 may be elastically coupled to each other through the elastic member 155 and thus the length of the link 150 may be variable.

The link 150 having the above-described configuration may serve to transfer the rotation force of the door 130 to the door key 170 so that the door key 170 is driven.

The door key 170 may be locked to the main body 110 in response to the cooking chamber (see 101 of FIG. 5) being closed through the door 130. A hooking hole 171 to which a hook portion 191 of a locking member 190 is detachably coupled may be formed in the door key 170 as illustrated in FIG. 7. A first hinge protrusion 172 may be formed in one end of the door key 170 and the first hinge protrusion 172 may be pivotally coupled to the hinge bracket 157. The door key 170 may include an extension portion 173 which is formed to slantly extend at a fixed angle from the one end of the door key 170.

The extension portion 173 may be pivotally coupled to the connection hole 154 of the second part 153 of the link 150. The extension portion 173 may control the point of time when the door key 170 is drawn into the inside of the door 130 or is drawn out to the outside of the door 130 according to the set length of the extension portion 173. For example, the shorter the length of the extension portion 173 is, the faster the speed that the door key 170 is drawn into the inside of the door 130 or is drawn out to the outside of the door 130 within the same rotation angle range of the door 130 is.

FIGS. 9A to 9D are diagrams sequentially illustrating an operation example of a door key while the door is opened from a main body of an oven to open a cooking chamber according to an exemplary embodiment.

A process that the door key 170 is drawn into the inside of the door 130 in association with the rotation of the door 130 while the door 130 including the link 150 and the door key 170 is opened will be described with reference to FIGS. 9A to 9D.

Figure 9A:
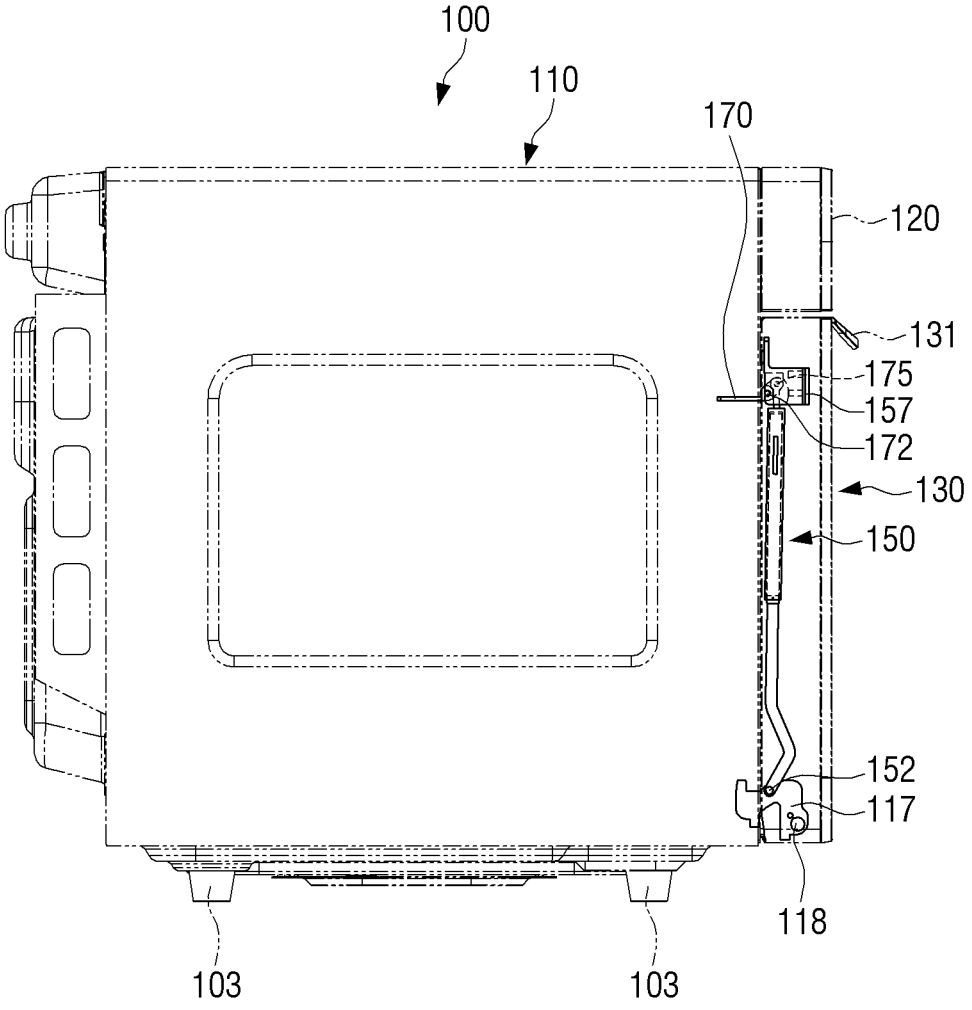
FIGS. 9A to 9D are diagrams sequentially illustrating an operation example of a door key while the door is opened from a main body of an oven to open a cooking chamber according to an exemplary embodiment.

As illustrated in FIG. 9A, the door key 170 may be inserted into the main body 110 through the insertion hole (see 116 of FIG. 5) of the main body in a state that the cooking chamber (see 101 of FIG. 5) of the main body 110 is closed through the door 130. For example, the hook portion 191 of the locking member 190 may be inserted into the hooking hole 171 of the door key 170 and the door 130 may be locked to the main body 110. In FIG. 9A, the reference numeral 103 refers to a plurality of seating packings fixed to a bottom surface of the main body 110. The seating packing 103 may allow the bottom surface of the main body 110 to be spaced from a floor so that the front surface of the door 130 may not be in contact with the floor in response to the door 130 being opened to a maximum angle as illustrated in FIG. 9D.

Figure 9B:
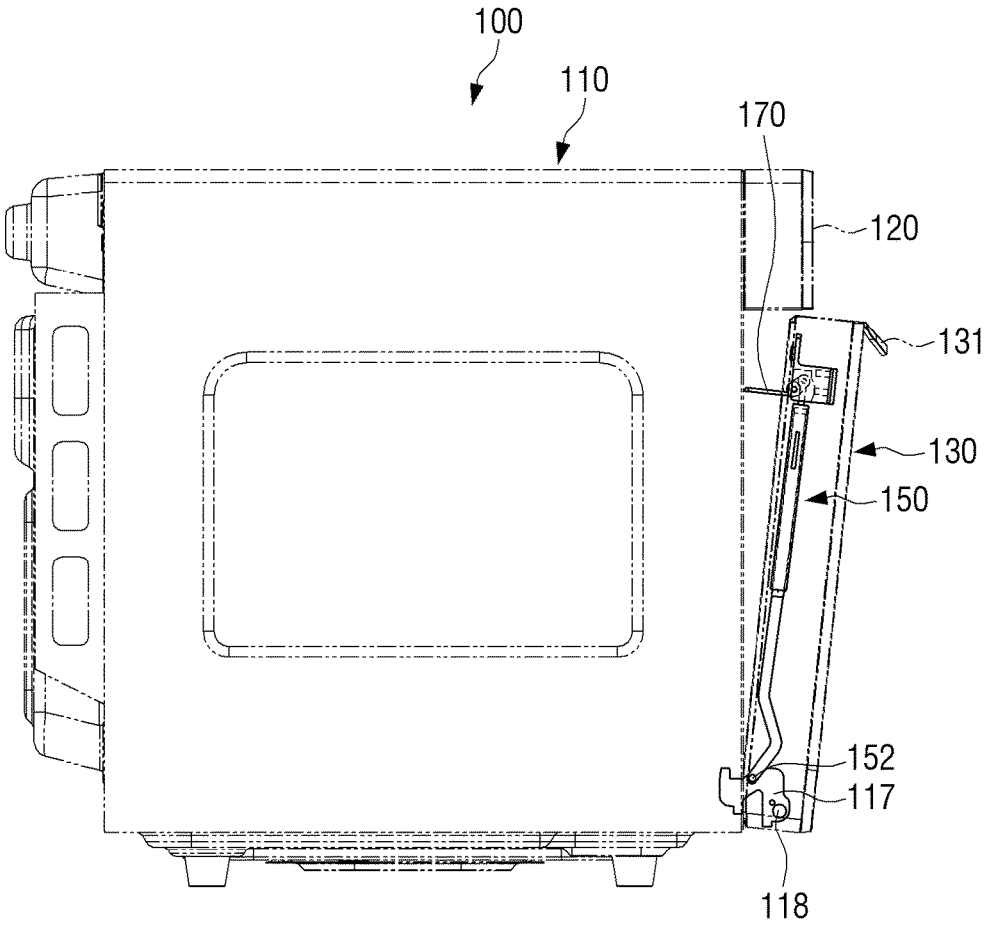

FIG. 9B illustrates an example that the door key 170 is completely separated from the insertion hole (see 116 of FIG. 5) in response to the door 130 being rotated clockwise to open the cooking chamber 101. In a process that the door 130 moves from a door position of FIG. 9A to a door position of FIG. 9B, the door key 170 may move to a direction that the door key 170 is separated from the insertion hole 116. The door key 170 may interfere with the hook portion 191 of the locking member 190 inserted into the hooking hole 171 of the door key 170 through the movement of the door key 170 and thus the locking member 190 may rotate counterclockwise about a rotation shaft 193. Accordingly, the hook portion 191 may be deviated from the hooking hole 171 and the locking of the door 130 may be released. Then, the locking member 190 may rotate clockwise about the rotation shaft 193 through an elastic member (not shown) and the hook portion 191 may move to the original position.

The door key 170 may be in a rotatable state so that the door key 170 may be drawn into the inside of the door 130 from a point of time when the door key 170 is completely detached from the insertion hole 116 as illustrated in FIG. 9B.

Figure 9C:
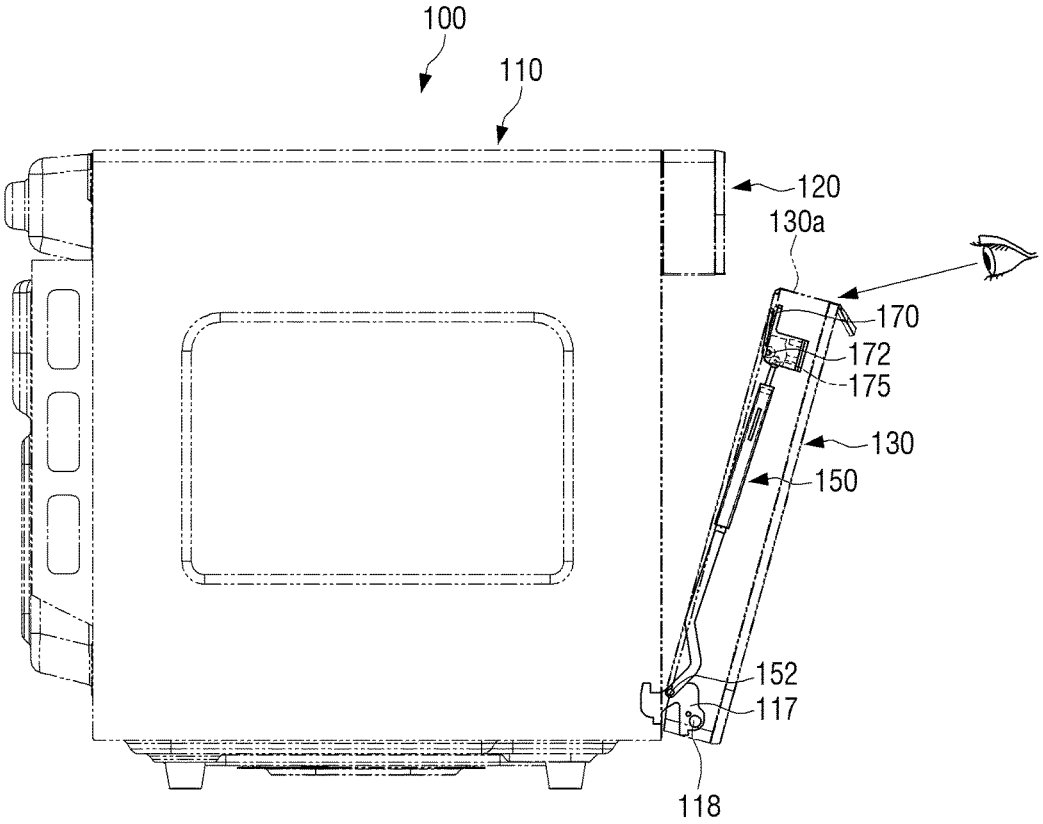
Figure 9D:
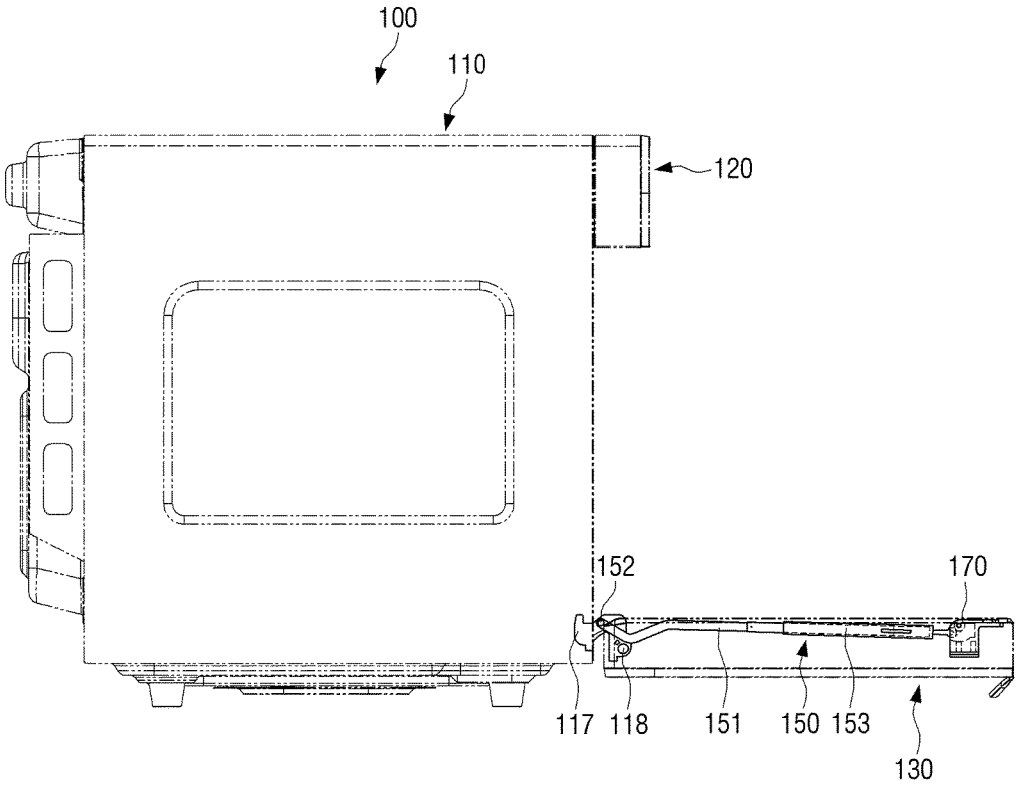

In response to the door 130 being rotated clockwise from the position illustrated in FIG. 9B to a position illustrated in FIG. 9C, the link 150 may rotate about the hinge protrusion 152 according to the rotation of the door 130. Accordingly, the extension portion (see 173 of FIG. 8) is pulled clockwise through the link 150 and the door key 170 may rotate clockwise about the second rotation protrusion 175 and may be drawn into the inside of the door 130.

Referring to FIG. 9C, while the door 130 is opened, the door key 170 may be smoothly covered with the operation unit 120 located over the door 130 and the upper end portion 130*a* of the door 130. Accordingly, the user may not recognize the operation of the door key 170. In response to the operation of the door key 170 being performed out of a recognizable range of the user, the operation of the door key 170 which may offend the user's eyes may be hidden.

In response to the door 130 being rotated clockwise from the position of FIG. 9C to a position of FIG. 9D, the cooking chamber 101 is completely opened.

The door key 170 may be already drawn into the inside of the door 130 in response to the door 130 being located in the position of FIG. 9C. For example, while the door 130 rotates to the position of FIG. 9D in a state that the door key 170 is drawn into the inside of the door 130, the first and second parts 151 and 153 of the link 150 may slidably move to a direction far away from each other and the length of the link 150 may extend. In this example, the door key 170 may maintain the state inserted into the door 130 as it is.

As illustrated in FIG. 9D, in response to cooking materials for cooking being into the cooking chamber 101 or being taken out from the cooking chamber 101 in a state that the cooking chamber 101 is completely opened through the door 130, the interference of the door key 170 may be fundamentally overcome.

In response to the door 130 being closed to close the cooking chamber 101 as illustrated in FIG. 9A in a state that the cooking chamber 101 is opened to the maximum angle as illustrated in FIG. 9D, the door key 170 may operate in reverse order to the opening process of the door 130. For example, the door key 170 may be drawn out from the door 130, inserted into the insertion hole 116 of the main body 110, and fixed through the locking member 190.

The above-described door key provided in the household electric appliance according to an exemplary embodiment may rotate to the same direction as the rotation direction of the door and may be drawn into/out from the door in the door rotation. However, this is not limited thereto, and the door key may be configured to rotate to the direction opposite to the rotation direction of the door and to be drawn into/out from the door in the door rotation. Another exemplary embodiment will be described with reference to FIGS. 10A to 10C.

Figure 10A:
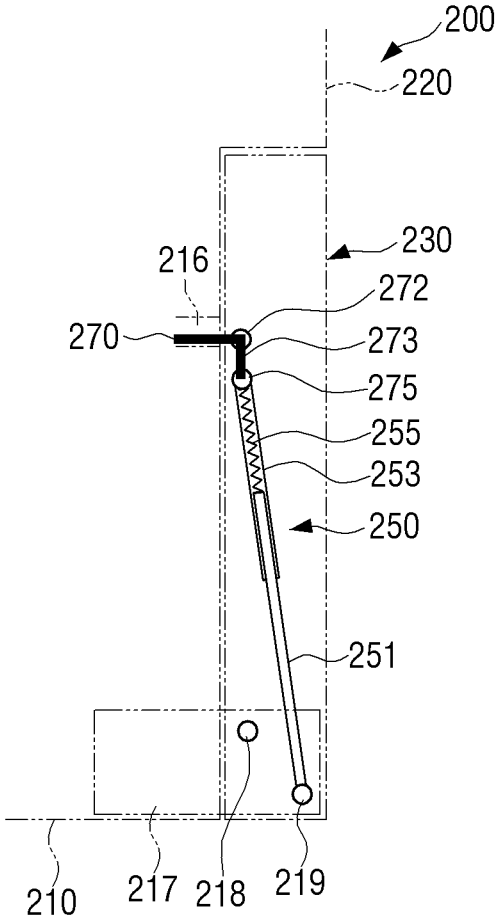
FIGS. 10A to 10C are diagrams sequentially illustrating an operation example of a door key linked to rotation of a door in a household electric appliance according to another exemplary embodiment.
Figure 10B:
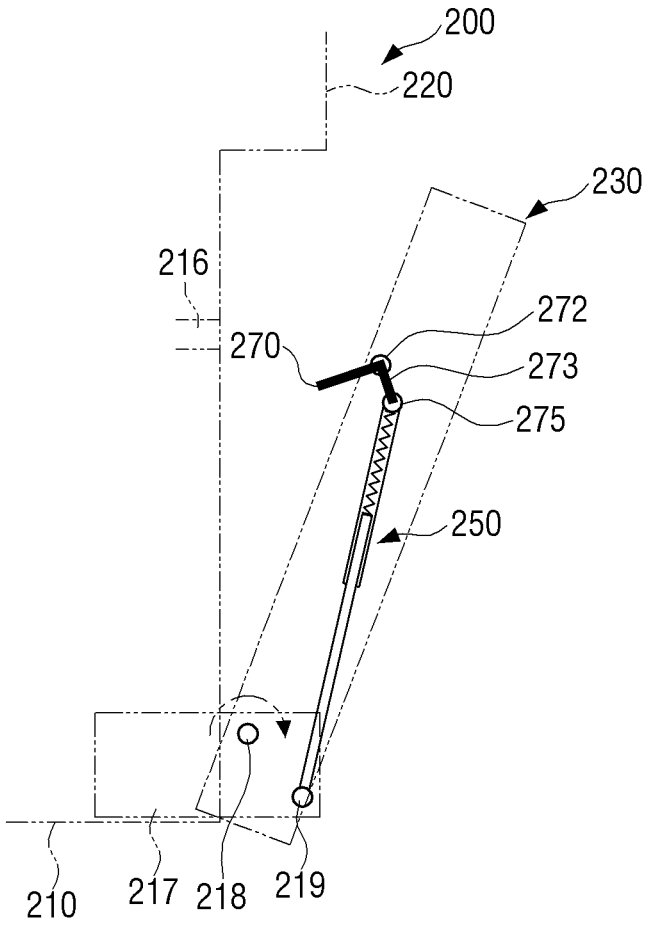
Figure 10C:
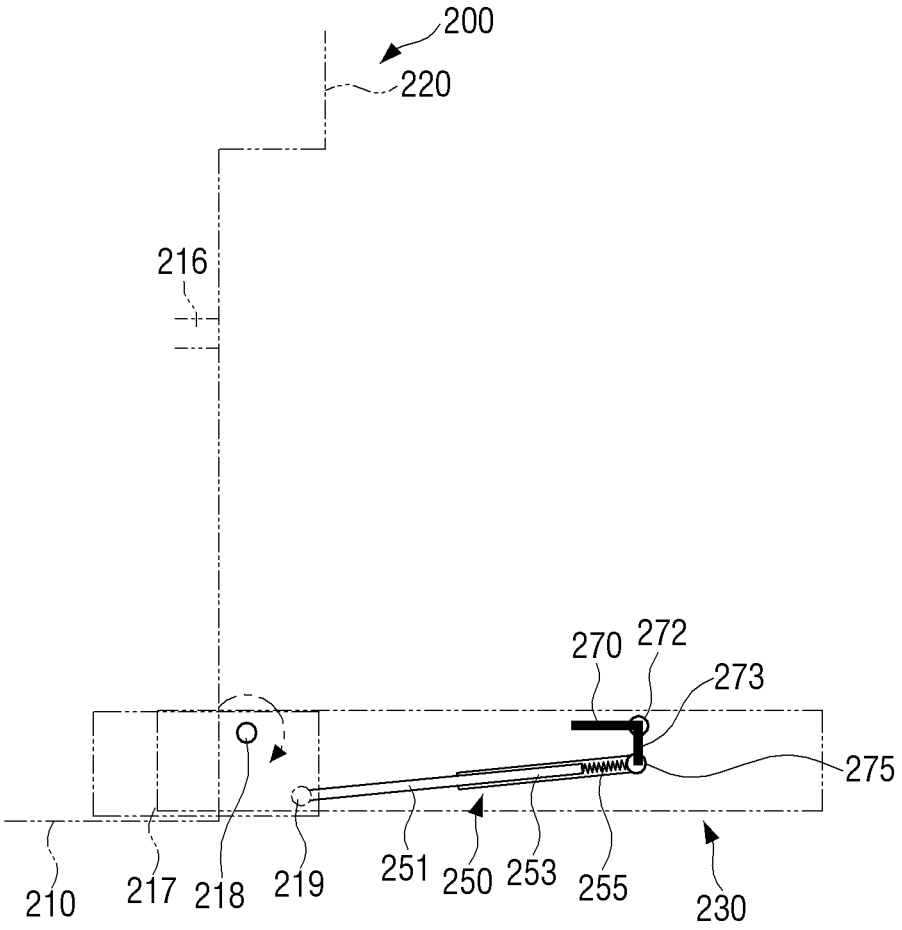

FIGS. 10A to 10C are diagrams sequentially illustrating an operation example of a door key linked to rotation of a door in a household electric appliance according to another exemplary embodiment.

Referring to FIG. 10A, a household electric appliance 200 may include a door key 270 having the same configuration as those of the door keys 13 and 170 of FIGS. 1A and 9A in that an extension portion 273 is formed in the door key 270 and an end portion of the extension portion 273 is pivotally coupled to an upper end 275 of a second part 253 of a link 250.

However, the household electric appliance 200 may have the different configuration from those in the household electric appliances of FIGS. 1A and 9A in that a hinge shaft 218 of a door 230 illustrated in FIG. 10A is disposed closer to a main body 210 side rather than a hinge shaft 219 coupled to a lower end of a first part 251 of the link 250 and the hinge shaft 218 of the door 230 may be set in a position higher than the hinge shaft 219 coupled to the lower end of the first part 251.

In response to the door 230 in the household electric appliance having the above-described configuration being rotated clockwise as illustrated in FIG. 10B, the extension portion 273 may be pushed upward through the link 250. Accordingly, the door key 270 may rotate counterclockwise about a rotation shaft 272 and then rotate toward the inside of the door 230.

While the door 230 rotates clockwise and moves from a position of FIG. 10B to a position of FIG. 10C, the door key 270 may rotate counterclockwise and may be drawn into the inside of the door 230. After the door key 270 is drawn into the inside of the door 230, the length of the link 250 may extend so that the door 230 may be continuously rotated.

As illustrated in FIG. 10C, the first part 251 and the second part 253 of the link 250 may be elastically coupled to each other through an elastic member 255 and thus the length of the link 250 may extend in response to the door 230 being rotated to a door closing direction (for example, counterclockwise direction).

In FIGS. 10A to 10C, the reference numerals 216, 217, and 220 may refer to an insertion hole, a supporting piece, and an operation unit.

The example that the door key is linked to the rotation of the door through the link has been described, but this is not limited to the structure and a configuration that the link is omitted and the door key is linked to the door through gravity like exemplary embodiments to be described with reference to FIGS. 11A to 12D hereinafter may be employed.

Figure 11A:
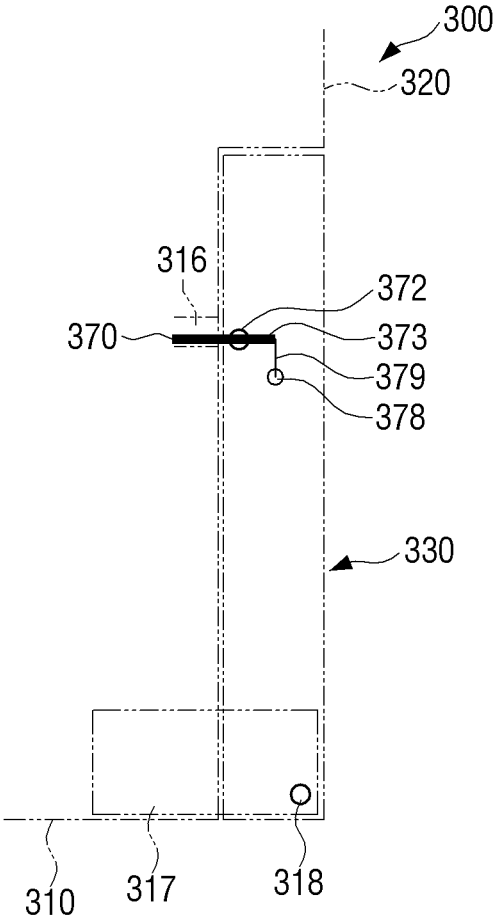
FIGS. 11A to 11C are diagrams sequentially illustrating an operation example of a door key linked to rotation of a door in a household electric appliance according to another exemplary embodiment.
Figure 11B:
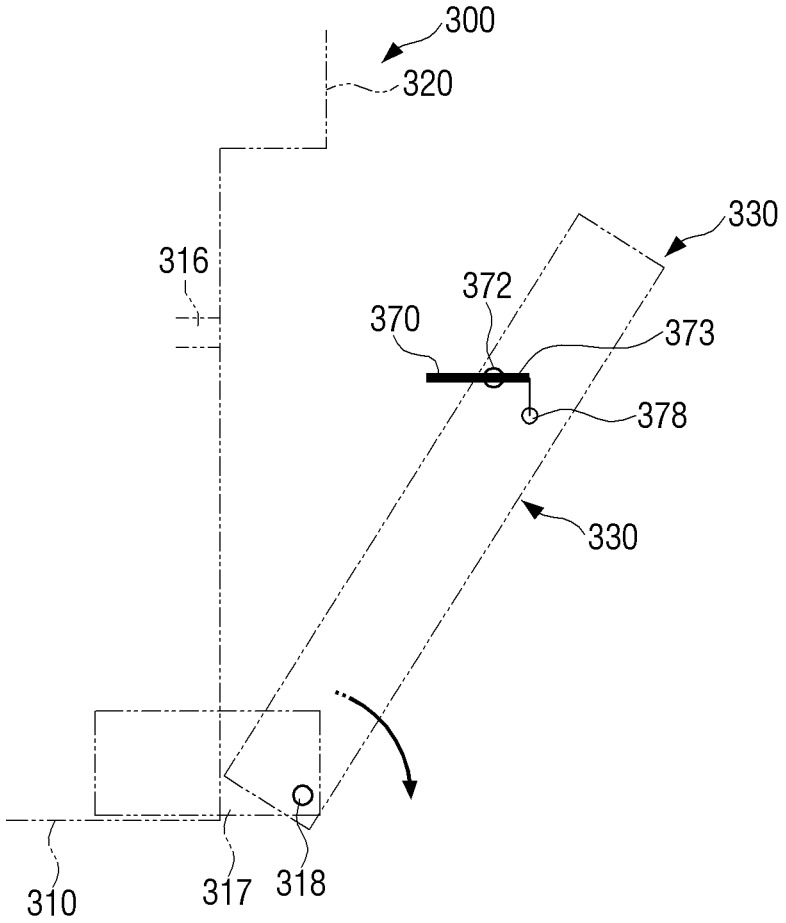
Figure 11C:
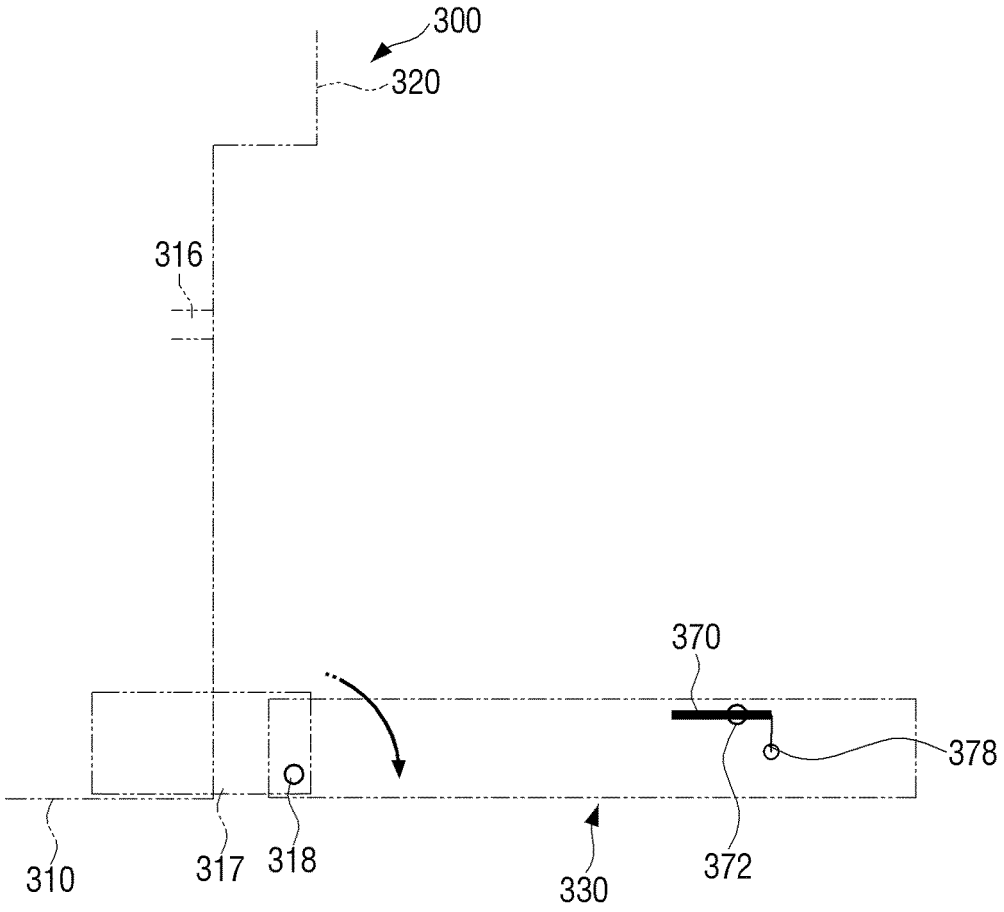

FIGS. 11A to 11C are diagrams sequentially illustrating an operation example of a door key linked to rotation of a door in a household electric appliance according to another exemplary embodiment.

Referring to FIG. 11A, a household electric appliance 300 may include a main body 310 and a door 330 pivotally coupled to the main body 310 through a supporting piece 317. The household electric appliance 300 may have the same configuration as those in the above-described exemplary embodiments except that the link is omitted and a door key 370 operates using gravity.

The door key 370 may be pivotally coupled to the door 330 through a rotation shaft 372. The door key 370 may be detachably inserted into an insertion hole 316 of the main body 310 and may be locked and unlocked through a certain locking member (not shown) provide in the main body 310.

An extension portion 373 may be formed in an end portion of the door key 370 and a weight structure 378 having fixed weight may be provided in the extension portion 373. For example, the weight structure 378 may be coupled to the extension portion 373 through a connection member 379 configured of a thin and flexible material like thread. In this example, the weight of the door key 370 located in one side on the basis of the rotation shaft 372 may be set equal to a sum of weights of the extension portion 373, the weight structure 378, and the connection member 379 located in the other side on the basis of the rotation shaft 372. This is to maintain level continuously in response to the door key 370 being rotated about the rotation shaft 372 in association with the rotation of the door 330 in the clockwise/counterclockwise rotation of the door 330.

In response to the door 330 being rotated clockwise at a fixed angle about a rotation shaft 318 as illustrated in FIG. 11B in a state that a space provided in the inside of the main body 310 is closed through the door 330 as illustrated in FIG. 11A, the door key 370 may be deviated from the insertion hole 316 of the main body 310. The door key 370 may rotate counterclockwise about the rotation shaft 372 in association with the rotation of the door 330 and may maintain level.

In response to the door 330 being continuously rotated clockwise and then being opened until the door is in an almost horizontal state as illustrated in FIG. 11C, the door key 370 may also continuously maintain level in association with the rotation of the door 300 and simultaneously the door key 370 may rotate counterclockwise about the rotation shaft 372 and may be smoothly drawn into the inside of the door 330.

In response to the door 330 being rotated counterclockwise and being closed in a state that the door 330 is completely opened as illustrated in FIG. 11C, the door key 370 may rotate clockwise in association with the door 330 and simultaneously maintain level. In order for the door key 370 to continuously maintain level in the rotation of the door 330, the door key 370 may be relatively rotated with respect to the rotation of the door 330.

In FIGS. 11A to 11C, the reference numeral 220 may refer to an operation unit.

FIGS. 12A to 12D are diagrams sequentially illustrating an operation example of a door key linked to rotation of a door in a household electric appliance according to another exemplary embodiment.

Figure 12A:
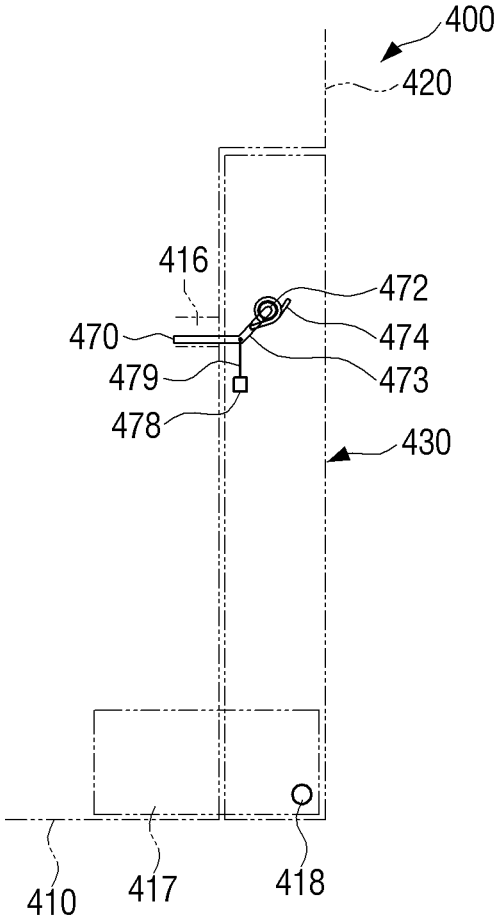
FIGS. 12A to 12D are diagrams sequentially illustrating an operation example of a door key linked to rotation of a door in a household electric appliance according to another exemplary embodiment.

The door key 470 may have the same configuration as the door key 370 of the household electric appliance 300 illustrated in FIG. 11A in that an extension portion 473 may be formed in the door key 470 provided in a household electric appliance 400 illustrated in FIG. 12A and a weight structure 478 may be coupled to the extension portion 473 through a connection member 479.

For example, an upper end of the connection member 479 which the weight structure 478 is hung on a lower end thereof may be coupled between the door key 470 and the extension portion 473. A rotation shaft 472 as a rotation center of the door key 470 may be set substantially to a position corresponding to an end portion of the extension portion 473. The extension portion 473 may be elastically rotatably coupled to the rotation shaft 472 thorough an elastic member 474, for example, a torsion spring. The elastic member 474 may have elastic force corresponding to a sum (hereinafter, referred to as 'total weight of a configuration related to a door key') of weights of the door key 470, the extension portion 473, the weight structure 478, and the connection member 479 or may have a somewhat lesser degree of elastic force than the total weight.

Figure 12B:
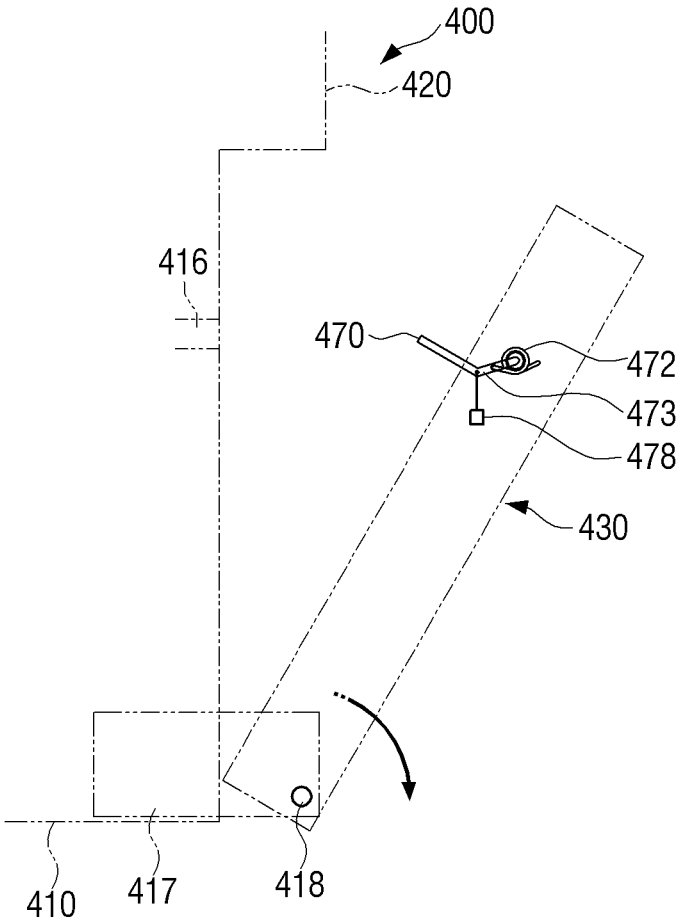

In the household electric appliance 400 having the above-described configuration, in response to the door 430 being rotated clockwise at a fixed angle about a rotation shaft 418 of supporting piece 417 as illustrated in FIG. 12B in a state that a space provided in the inside of the main body 410 is closed through the door 430 as illustrated in FIG. 12A, the door key 470 may be deviated from an insertion hole 416 of the main body 410. Household electric appliance 400 may also include operation unit 420.

Figure 12C:
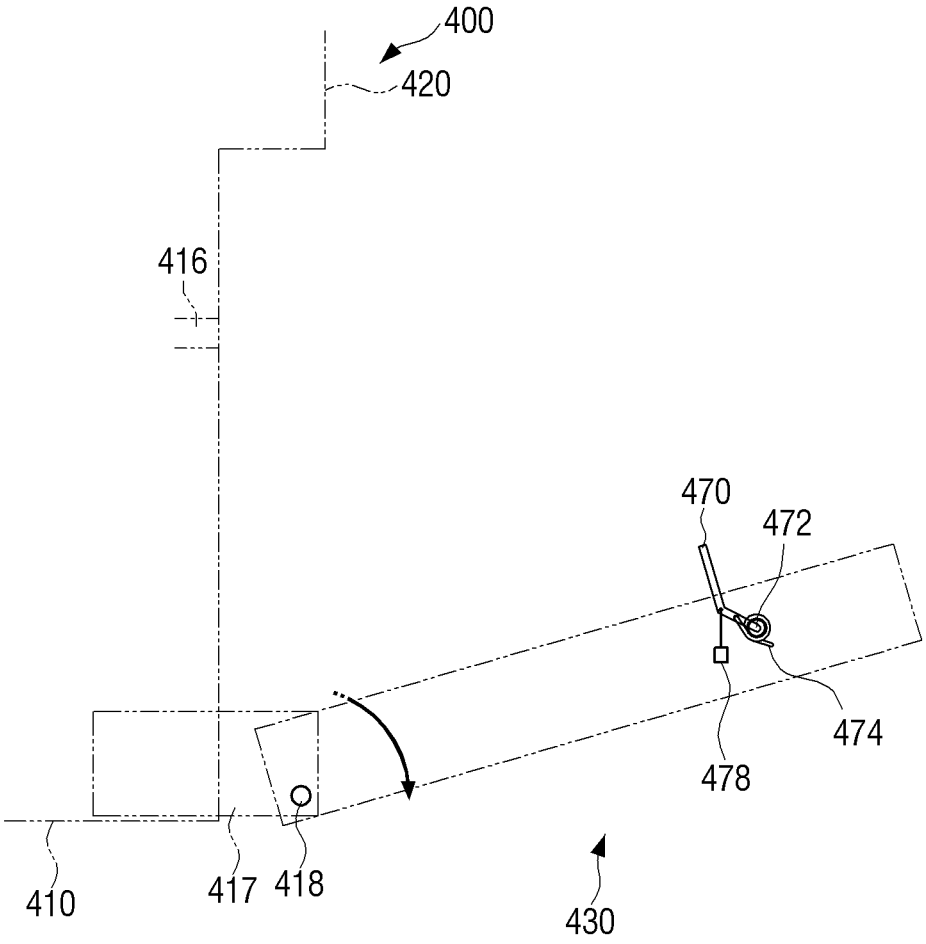

For example, while the door 430 is opened to an almost horizontal state as illustrated in FIG. 12C, the door key 470 may maintain a protruding state from the door 430 as it is. This is because the total weight of a configuration related to a door key is equal to or larger than the elastic force of the elastic member 474.

Figure 12D:
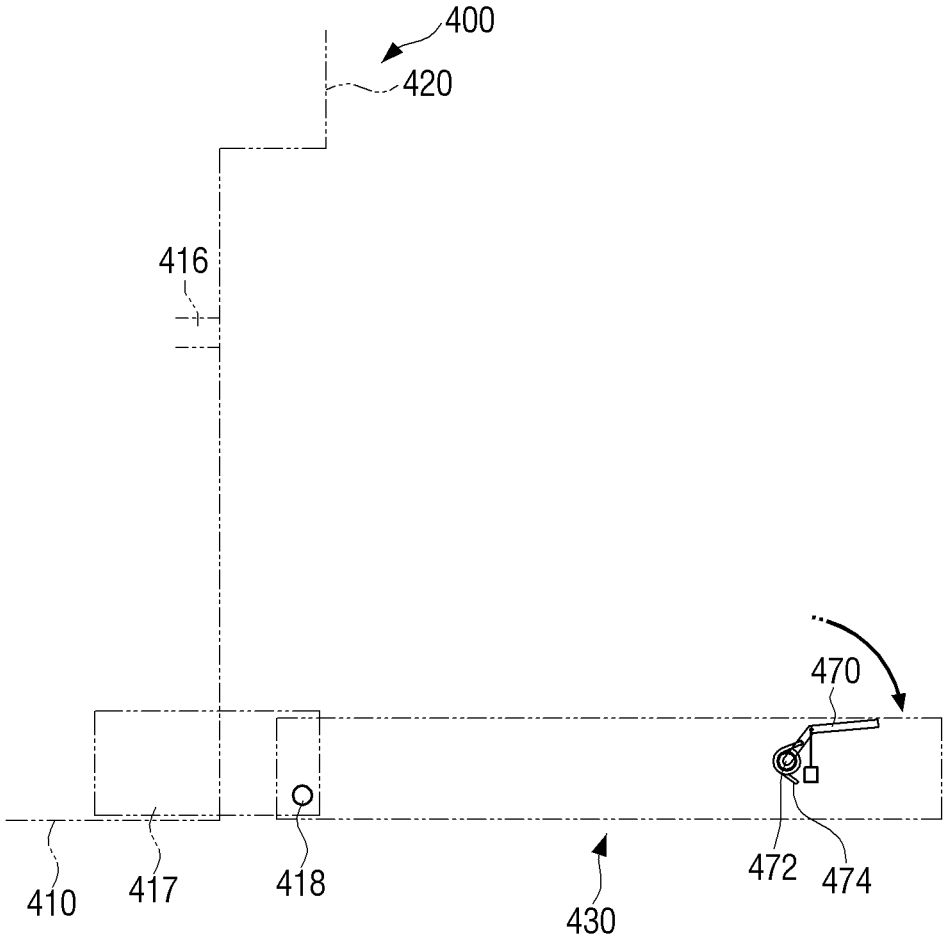

In response to the door 430 being rotated clockwise to be in a complete horizontal state or being overrotated clockwise as illustrated in FIG. 12D, the weight center of a configuration related to a door key may move close to the rotation shaft 472 and the elastic force of the elastic member 474 may overcome the total weight of a configuration related to a door key. Accordingly, the door key 470 may be rotated clockwise about the rotation shaft 472 and may be drawn into the inside of the door 430.

For example, the weight center of a configuration related to a door key may not move to the rotation shaft 472 direction only while the door 430 is rotated from a position of FIG. 12C to a position of FIG. 12D but the weight center of a configuration related to a door key may gradually move toward the rotation shaft 472 in the total rotation section for opening the door 430. Accordingly, the door key 470 of the household electric appliance 400 illustrated in FIG. 12A may also be operated in association with the rotation of the door 430 like the above-described exemplary embodiments.

Figure 13A:
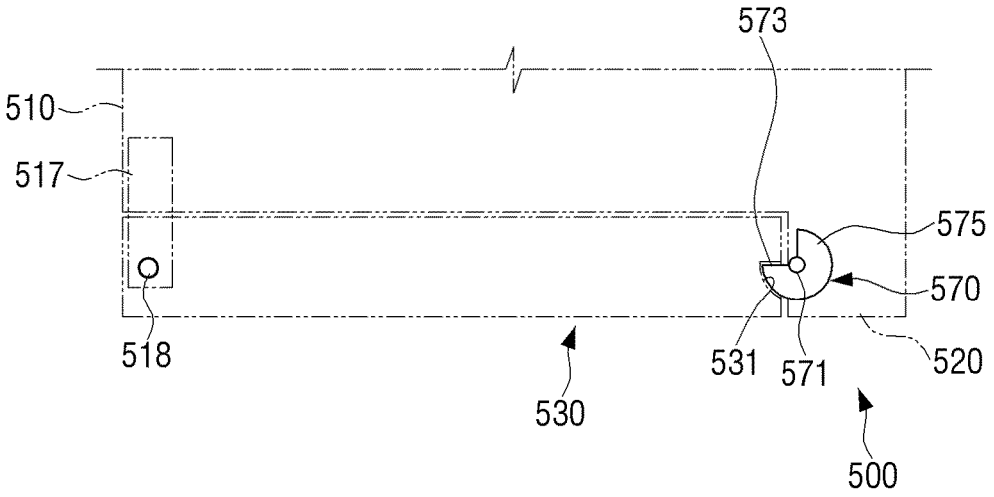
FIGS. 13A and 13B are diagrams sequentially illustrating an operation example of a door key linked to rotation of a door in a household electric appliance according to another exemplary embodiment.
Figure 13B:
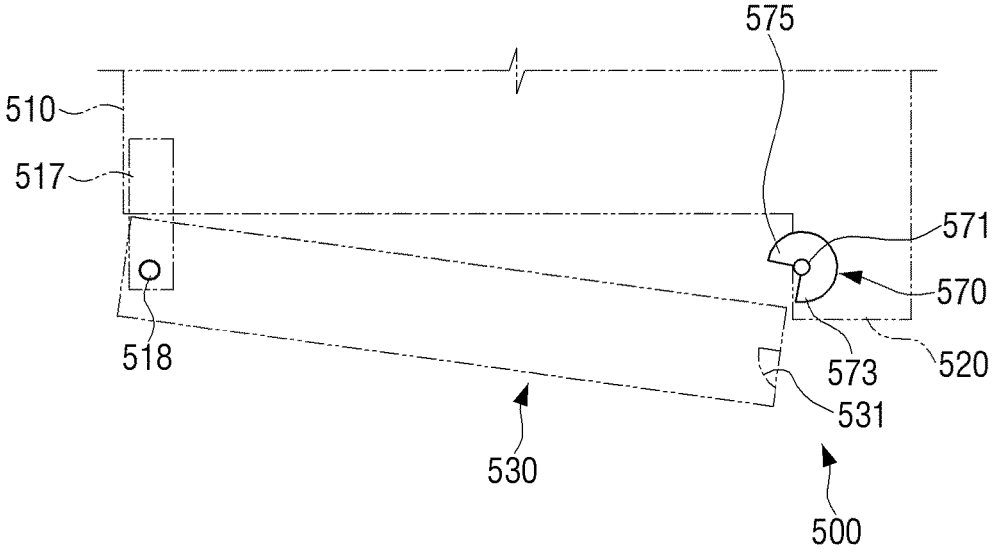

It has been described in the above-described exemplary embodiments that the door key is provided in the door, but this is not limited thereto and the door key may be operated in associated with the rotation of the door even in response to the door key being provided not in the door but in the main body as illustrated in FIGS. 13A and 13B.

FIGS. 13A and 13B are diagrams sequentially illustrating an operation example of a door key linked to rotation of a door in a household electric appliance according to another exemplary embodiment.

Referring to FIG. 13A, a household electric appliance 500 may include a main body 510 and a door 530 pivotally coupled to the main body 510 through a supporting piece 517. The door 530 may be pivotally coupled to the support piece 517 of the main body 510 through a hinge shaft 518.

A door key 570 may be rotatably disposed in one side of an operation unit 520 of the main body 510. The door key 570 may rotate clockwise/counterclockwise about a rotation shaft 571 in association with the door 530 and simultaneously may be detachably inserted into an insertion hole 531 of the door 530. For example, the operation unit 520 may not include the configuration for control of the household electric appliance 500 but the operation unit 520 may be merely a portion protruding from the main body 510.

A cam structure may be applied to a portion of the door key 570 and a portion of the main body 510 in which the door key is installed may interfere with the cam structure. The term "interfere" may refer to maintain a state that an outer circumference of the door key 570 may be in contact with the portion of the main body 510 in which the door key 570 is installed and may be pressed. Accordingly, the rotation of the door key 570 may be limited. The point of time when the rotation of the door key 570 is limited may be a point of time when the door 530 keeps close as illustrated in FIG. 13A.

The linkage process of the door key 570 to the rotation of the door 530 will be described below. One portion 573 of the door key 570 may be inserted into the insertion hole 531 of the door 300 in a state that the door 530 is closed as illustrated in FIG. 13A. In response to the door 530 being rotated clockwise at a fixed angle to open the door 530 as illustrated in FIG. 13B in the state that the portion of the door key 570 is inserted into the insertion hole 531, a portion of the insertion hole 531 may interfere with the door key 570 and simultaneously the door key 570 may rotate counterclockwise about the rotation shaft 571. In the door key rotation process, the one portion 573 of the door key 570 may be deviated from the insertion hole 531 and then may be drawn into the inner side of the operation unit 520 of the main body 510 and the other portion 575 of the door key 570 may protrude toward the outside of the operation unit 520 of the main body 510.

The door key 570 may be coupled to the rotation shaft 571 through a certain elastic member (not shown), for example, a torsion spring.

In response to the door 530 being rotated counterclockwise and closed, the other portion 575 of the door key 570 may be pushed through the door 530 and drawn into the inside of the operation unit 520 and simultaneously the one portion 573 of the door key 570 may be drawn out from the operation unit 520 and inserted into the insertion hole 531 of the door 530.

The door key 570 may be operated in association with the rotation of the door 530 even in response to the door key 570 being located in a portion (for example, the operation unit 520) of the main body 510.

Figure 14:
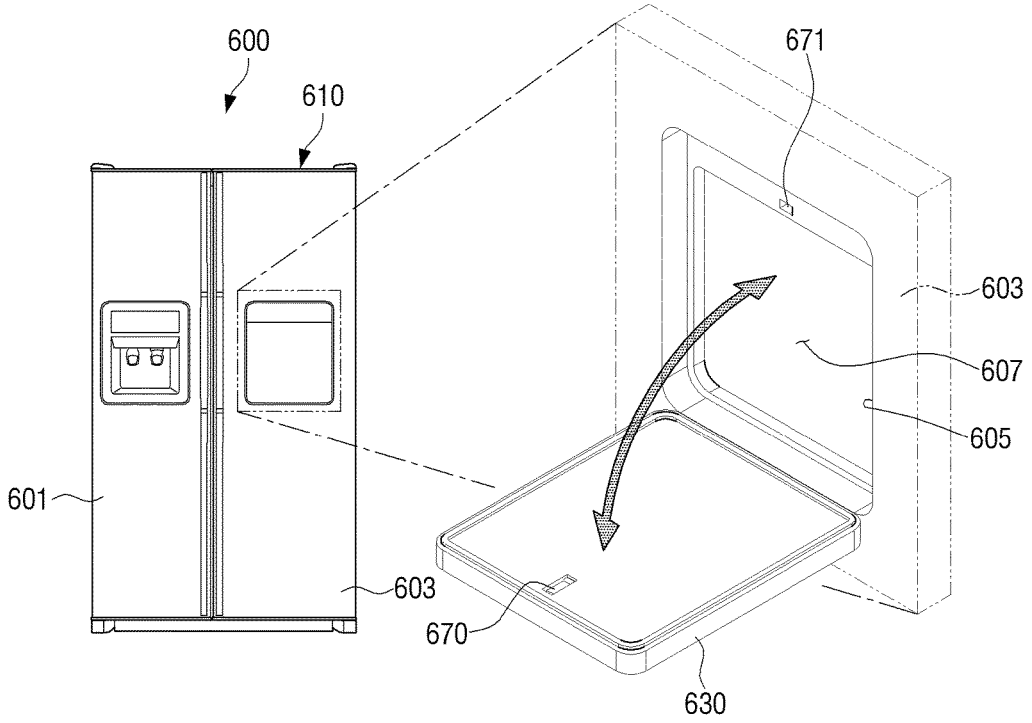
FIG. 14 is a diagram illustrating an example that a structure including a door key linked to a door is applied to an auxiliary door of a refrigerator according to an exemplary embodiment.
Figure 15:
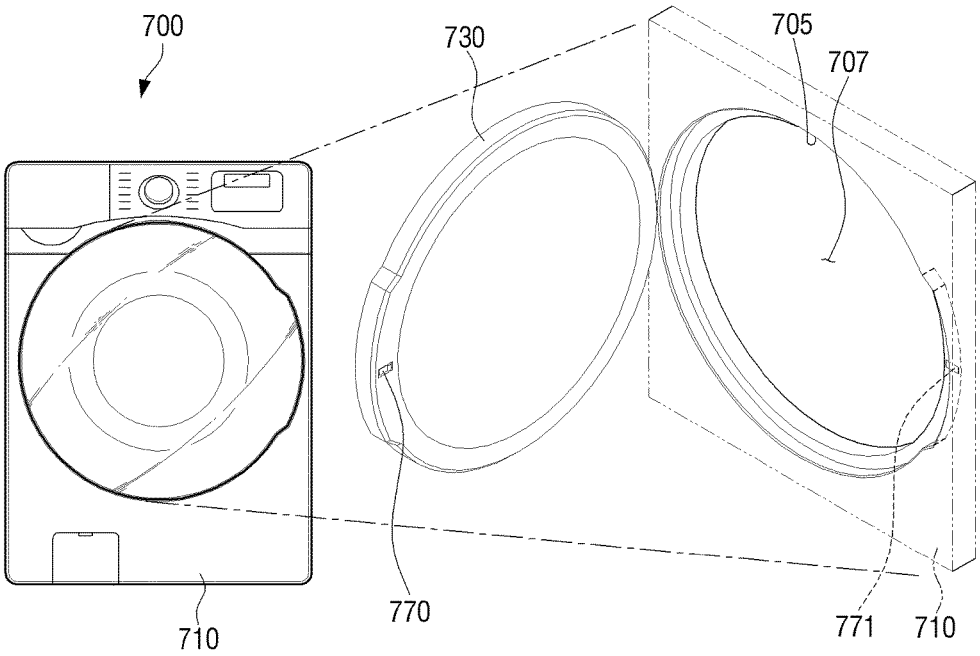
FIG. 15 is a diagram illustrating an example that a structure including a door key linked to a door is applied to a door of a washing machine according to an exemplary embodiment.

FIGS. 14 and 15 are diagrams illustrating examples that a structure including a door key linked to a door is applied to an auxiliary door of a refrigerator and a door of a washing machine according to an exemplary embodiment.

Referring to FIG. 14, a door key 670 linked to an auxiliary door 630 may be applied to the auxiliary door 630, which may refer to, for example, a home bar, installed in any one 603 of main doors 601 and 603 of a refrigerator 600, having a main body 610.

In response to a receiving space 607 in an inner side of the main door 603 being closed, the door key 670 may be inserted into an insertion hole 671 formed in a periphery of an opening 605 and may be locked through a certain locking member (not shown).

Referring to FIG. 15, a door key 770 according to an exemplary embodiment may be applied to a door 730 of a washing machine 700. The door key 770 may be detachably inserted into an insertion hole 771 formed in a periphery 705 of an opening 707 of a main body 710 of the washing machine. In response to the door key 770 being inserted into the insertion hole 771, the door key 770 may be locked through a certain locking member (not shown) provided in the main body 710 of the washing machine.

Although not shown in FIGS. 14 and 15, the structure of the door key linked to the rotation of the door according to the exemplary embodiment may applied to any one of household electric appliances including a main body and a door coupled to the main body such as an electric rice cooker and a dryer.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An electric appliance comprising:

a main body having a space therein, and including a locking member;

a door pivotally coupled to the main body to be rotatable about a first rotation axis from a position in which the door opens the space, to a position in which the door closes the space, and from the position in which the door closes the space, to the position in which the door opens the space; and a door key pivotally coupled to the door to be rotatable about a second rotation axis, different than the first rotation axis, so that a rotation of the door about the first rotation axis from the position in which the door opens the space, to the position in which the door closes the space, causes the door key to rotate about the second rotation axis from a position inside the door so as to protrude from the door to enter into the main body to be coupled with the locking member, and thereby lock the main body and the door together, and a rotation of the door about the first rotation axis from the position in which the door closes the space with the door key being coupled with the locking member to lock the main body and the door together, to the position in which the door opens the space, causes the door key to rotate about the second rotation axis to thereby be uncoupled from the locking member and be drawn out of the main body to inside the door so as not to protrude from the door, and thereby unlock the main body and the door from each other.

2. The electric appliance as claimed in claim 1, further comprising a link between the main body and the door key, wherein one end of the link is pivotally coupled to the main body so as to be rotatable about a third rotation axis and the other end of the link is pivotally coupled to the door key so as to be rotatable about a fourth rotation axis.

3. The electric appliance as claimed in claim 2, wherein when the door rotates from the position in which the door closes the space to the position in which the door opens the space, the door rotates through a preset angle section, and the link has a length that varies while the door rotates through at least a portion of the preset angle section.

4. The electric appliance as claimed in claim 3, wherein the link includes:

a first part and a second part slidably coupled to each other along a length direction; and an elastic member configured to elastically couple the first part and the second part so that a total length of the link is elastically increased or reduced.

5. The electric appliance as claimed in claim 2, wherein a rotation center of the second rotation axis is arranged closer to the main body than a pivot point of the other end of the link about the fourth rotation axis.

6. The electric appliance as claimed in claim 2, wherein the link is disposed in an inside of the door.

7. The electric appliance as claimed in claim 1, wherein when the door rotates from the position in which the door closes the space to the position in which the door opens the space, the door rotates through a first angle section and then a second angle section, the door key rotates about the second axis while the door rotates through the first angle section, and the door key does not rotate about the second axis while the door rotates through the second angle section.

8. The electric appliance as claimed in claim 7, wherein the door key rotates in a same direction as a rotation direction of the door while the door rotates through the first angle section.

9. The electric appliance as claimed in claim 7, wherein the door key rotates in a direction opposite to a rotation direction of the door while the door rotates through the first angle section.

10. The electric appliance as claimed in claim 7, wherein the door includes a hole on an inner surface of the door, as the door rotates through the first angle section, the door key enters the hole, and the door key is located inside the hole of the door while the door rotates through the second angle section.

11. The electric appliance as claimed in claim 1, wherein the door key includes an extension portion formed in one end of the door key, and the electric appliance further includes a weight structure coupled to the extension portion so that the door key maintains a level orientation while the door rotates to the position in which the door opens the space.

12. The electric appliance as claimed in claim 11, wherein the door key rotates in a direction opposite to a rotation direction of the door while maintaining the level orientation with respect to rotation of the door.

13. The electric appliance as claimed in claim 1, wherein the door key includes an elastic member having an elastic force, the electric appliance further includes a weight structure coupled to a portion of the door key, and a total weight, which is a sum of a weight of the door key and a weight of the weight structure, is equal to or larger than the elastic force of the elastic member.

14. The electric appliance as claimed in claim 13, wherein a weight center of the door key and the weight structure gradually, taken together, moves toward the second axis of the door key according to the rotation of the door.

15. The electric appliance as claimed in claim 14, wherein the door includes a hole on an inner surface of the door, and as the weight center moves to a position corresponding to the elastic force of the elastic member, thereby overcoming the total weight, the door key rotates and is drawn into the hole of the door.

16. The electric appliance as claimed in claim 1, wherein the electric appliance is any one of a microwave oven, an oven, a refrigerator, and a washing machine.

17. The electric appliance as claimed in claim 1, wherein the door includes a hole on a surface of the door, and, as the door rotates from the position in which the door closes the space to the position in which the door opens the space, the door key rotates about the second axis so that the door key is drawn into the hole.

* * * * *